US006571070B2

(12) United States Patent
Oguma et al.

(10) Patent No.: US 6,571,070 B2
(45) Date of Patent: May 27, 2003

(54) PROCESS CARTRIDGE AND IMAGE FORMING APPARATUS

(75) Inventors: Toru Oguma, Mishima (JP); Kazushi Watanabe, Mishima (JP); Akiyoshi Yokoi, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 09/758,285

(22) Filed: Jan. 12, 2001

(65) Prior Publication Data

US 2001/0017990 A1 Aug. 30, 2001

(30) Foreign Application Priority Data

Jan. 13, 2000 (JP) ..... 2000-004978
Jan. 5, 2001 (JP) ..... 2001-000864

(51) Int. Cl.[7] ..... G03G 15/08
(52) U.S. Cl. ..... 399/27; 399/90; 399/111
(58) Field of Search ..... 399/27, 61, 30, 399/62, 111, 119, 90, 113; 73/304 C

(56) References Cited

U.S. PATENT DOCUMENTS 5,095,335 A 3/1992 Watanabe et al.
5,151,734 A 9/1992 Tsuda et al.
5,208,634 A 5/1993 Ikemoto et al.
5,223,893 A 6/1993 Ikemoto et al.
5,294,960 A 3/1994 Nomura et al.
5,331,372 A 7/1994 Tsuda et al.
5,345,294 A 9/1994 Nomura et al.
5,404,198 A 4/1995 Noda et al.
5,455,665 A 10/1995 Baba et al.
5,463,446 A 10/1995 Watanabe et al.
5,465,136 A 11/1995 Watanabe
5,470,635 A 11/1995 Shirai et al.
5,475,470 A 12/1995 Sasago et al.
5,488,459 A 1/1996 Tsuda et al.
5,510,878 A 4/1996 Noda et al.
5,561,504 A 10/1996 Watanabe et al.
5,583,613 A 12/1996 Kobayashi et al.
5,602,623 A 2/1997 Nishibata et al.
5,608,509 A 3/1997 Shirai et al.

(List continued on next page.)

*Primary Examiner*—Robert Beatty
(74) *Attorney, Agent, or Firm*—Fitzpatrick, Cella, Harper & Scinto

(57) ABSTRACT

A process cartridge is detachably mountable to a main assembly of an electrophotographic image forming apparatus. The process cartridge includes an electrophotographic photosensitive member, a developing member for developing an electrostatic latent image forming on the electrophotographic photosensitive member, a developing device frame including a first frame portion supporting the developing member and a second frame portion having a developer accommodating portion for accommodating a developer to be used for developing the electrostatic latent image by the developing member, first and second electroconductive portions disposed to be spaced from each other to detect, by the main assembly of the apparatus, a remaining amount of the developer in the process cartridge, a cartridge contact electrically connectable with the main assembly of apparatus when the process cartridge is mounted to the main assembly of the apparatus, the cartridge contact being disposed in the second frame portion, a contacting electrode electrically connected with the cartridge contact, the contacting electrode being disposed in the second frame portion, and a first electroconductive portion contact electrically connected with the first electroconductive portion, the first electroconductive portion contact being disposed in the first frame portion. The first electroconductive portion contact and the contacting electrode contact each other between spaced apart connecting portions or between an elastic seal located between the first frame portion and the second frame portion.

19 Claims, 18 Drawing Sheets

U.S. PATENT DOCUMENTS 5,623,328 A 4/1997 Tsuda et al.
5,640,650 A 6/1997 Watanabe et al.
5,659,847 A 8/1997 Tsuda et al.
5,669,042 A 9/1997 Kobayashi et al.
5,768,658 A 6/1998 Watanabe et al.
5,790,923 A 8/1998 Oguma et al.
5,794,101 A 8/1998 Watanabe et al.
5,809,374 A 9/1998 Tsuda et al.
5,812,909 A 9/1998 Oguma et al.
5,828,928 A 10/1998 Sasago et al.
5,862,431 A * 1/1999 Christensen ..... 310/330
5,878,304 A 3/1999 Watanabe et al.
5,884,124 A 3/1999 Karakama et al.
5,903,803 A 5/1999 Kawai et al.
5,937,242 A 8/1999 Yokoyama et al.
5,940,658 A 8/1999 Yokoi et al.
6,006,058 A 12/1999 Watanabe et al.
6,016,413 A 1/2000 Yokoyama et al.
6,029,032 A 2/2000 Watanabe et al.
6,070,028 A 5/2000 Odagawa et al.
6,075,956 A 6/2000 Watanabe et al.
6,097,908 A 8/2000 Uchiyama et al.
6,097,909 A 8/2000 Watanabe et al.
6,101,354 A 8/2000 Nakagawa et al.
6,118,960 A 9/2000 Nakagawa et al.
6,128,454 A 10/2000 Kawai et al.
6,144,398 A 11/2000 Yokoyama et al.
6,144,821 A 11/2000 Oguma
6,160,976 A 12/2000 Karakama et al.
6,163,665 A 12/2000 Watanabe et al.
6,169,866 B1 1/2001 Watanabe et al.
6,175,706 B1 1/2001 Watanabe et al.
6,208,816 B1 * 3/2001 Koizumi et al. ..... 399/27
6,253,036 B1 * 6/2001 Karakama et al. ..... 399/119
6,349,184 B2 * 2/2002 Otomo ..... 399/110
6,377,759 B1 * 4/2002 Abe et al. ..... 399/27

* cited by examiner

PROCESS CARTRIDGE AND IMAGE FORMING APPARATUS

FIELD OF THE INVENTION AND RELATED AT

The present invention relates to a process cartridge and an electrophotographic image forming apparatus to which a process cartridge is detachably mountable.

Here, the electrophotographic image forming apparatus may be an electrophotographic copying machine, an electrophotographic printer (a LED printer, a laser beam printer or the like), an electrophotographic printer type facsimile machine, an electrophotographic printer type word processor or the like.

The process cartridge may contain as a unit an electrophotographic photosensitive member and at least one of a charge member, a developing member and a cleaning member, the unit being detachably mountable to the main assembly of the electrophotographic image forming apparatus. The process cartridge make contain as a unit an electrophotographic photosensitive member and at least a developing member, the unit being detachably mountable to a main assembly of the electrophotographic image forming apparatus.

In an electrophotographic image forming apparatus using the electrophotographic image forming process, use has been made of the process cartridge type apparatus in which the process cartridge comprises as a unit the electrophotographic photosensitive member and process means actable on the electrophotographic photosensitive member, the unit being detachably mountable to the main assembly of the electrophotographic image forming apparatus. With the use of the process cartridge type apparatus, the maintenance operation can be carried out in effect by the users without the necessity of relying on serviceman, and therefore, the operability is improved. Therefore, the process cartridge type apparatus is widely used in the field of electrophotographic image forming apparatus.

Furthermore, an example of a frame of a conventional process cartridge is as follows. The frame includes a developer chamber and a developer accommodating container, the developer chamber is provided with developing means including a developing member in the form of a developing roller for supplying the developer to an electrostatic latent image formed on an electrophotographic photosensitive member, and a developer layer thickness regulating member in the form of a developing blade for regulating a thickness of a layer of the developer carried on the developing roller, and the developer accommodating container including a developer accommodating portion provided with a developer feeding member. The developing device frame is coupled with a cleaning frame to which the electrophotographic photosensitive member, the cleaning member and a charge member are mounted.

It is conventional to use a developer amount detection electrode comprising a first electroconductive portion and a second electroconductive portion which constitute a capacitor in the developing device frame as a means for detecting a remaining amount of the developer in the process cartridge. A voltage is applied between the first electroconductive portion and the second electroconductive portion, and the change of the amount of the developer is detected as a change in the electrostatic capacity between the first electroconductive portion and the second electroconductive portion. In a process cartridge having such a type of detecting system, connection electrodes for supplying a developer amount detection bias to the detection electrode from the main assembly of the electrophotographic image forming apparatus and for supplying the detection bias to the main assembly of the electrophotographic image forming apparatus, are provided.

When the process cartridge is mounted to the main assembly of the image forming apparatus, the connection electrode provided in the process cartridge is electrically connected with the connection electrode provided in the main assembly of the image forming apparatus, thereby establishing an electrical connection therebetween. By doing so, the developer amount detecting means becomes operable.

Depending on the structure of the main assembly of the image forming apparatus and/or the construction of the process cartridge, the mounting position of the connection electrode may be limited. In such a case, during the process of assembling the process cartridge or the developing frame, it is necessary to electrically connect divided connection electrodes with each other.

SUMMARY OF THE INVENTION

Accordingly, it is a principal object of the present invention to provide a process cartridge and an electrophotographic image forming apparatus to which the process cartridge is detachably mountable in which the electrical connection in the process cartridge is assured.

It is another object of the present invention to provide a process cartridge and an electrophotographic image forming apparatus to which the process cartridge is detachably mountable, in which the voltage received by the process cartridge from the main assembly of the apparatus can be supplied assuredly to the right member.

It is a further object of the present invention to provide a process cartridge and an electrophotographic image forming apparatus to which the process cartridge is detachably mountable, in which the electrical connection is assured across frames.

It is a further object of the present invention to provide a process cartridge detachably mountable to a main assembly of an electrophotographic image forming apparatus, the process cartridge including an electrophotographic photosensitive member; a developing member for developing an electrostatic latent image formed on the electrophotographic photosensitive member; a developing device frame including a first frame portion supporting the developing member and a second frame portion having a developer accommodating portion for accommodating a developer to be used for developing the electrostatic latent image by the developing member; first and second electroconductive portions disposed to be spaced from each other to detect, by the main assembly of the apparatus, a remaining amount of the developer in the process cartridge; a cartridge contact electrically connectable with the main assembly of the apparatus when the process cartridge is mounted to the main assembly of the apparatus, the cartridge contact being disposed in the second frame portion; a contacting electrode electrically connected with the cartridge contact, the contacting electrode being disposed in the second frame portion; a first electroconductive portion contact electrically connected with the first electroconductive portion, the first electroconductive portion contact being disposed in the first frame portion, and the first electroconductive portion contact and the contacting electrode contacting each other at a connecting portion between the first frame portion and the second frame portion.

These and other objects, features and advantages of the present invention will become more apparent upon a consideration of the following description of the preferred embodiments of the present invention taken in conjunction with the accompanying drawings.

PREFERRED EMBODIMENT OF THE PRESENT INVENTION

A description will be provided as to the process cartridges and the electrophotographic image forming apparatus according to the embodiment of the present invention in conjunction with accompanying drawings.

Embodiment 1

Figure 1:
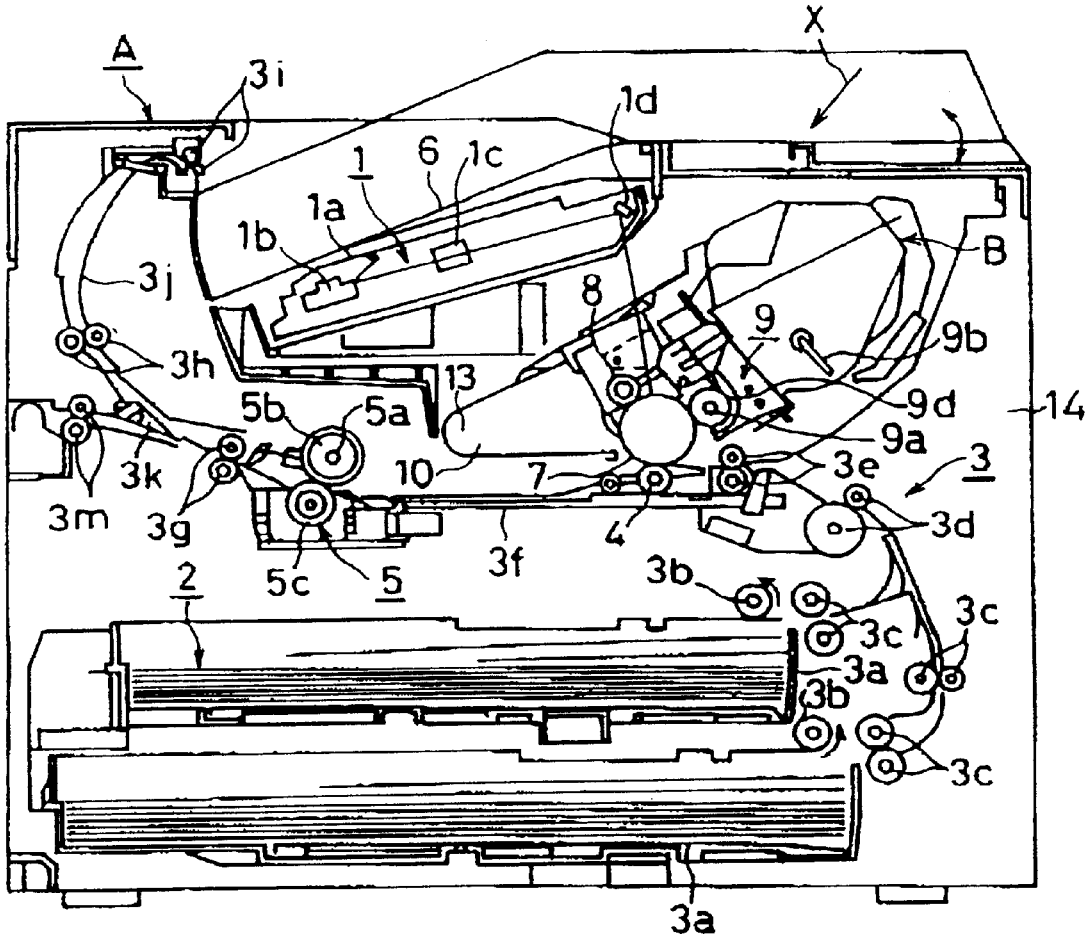
FIG. 1 is a schematic illustration of an electrophotographic image forming apparatus according to an embodiment of the present invention.
Figure 2:
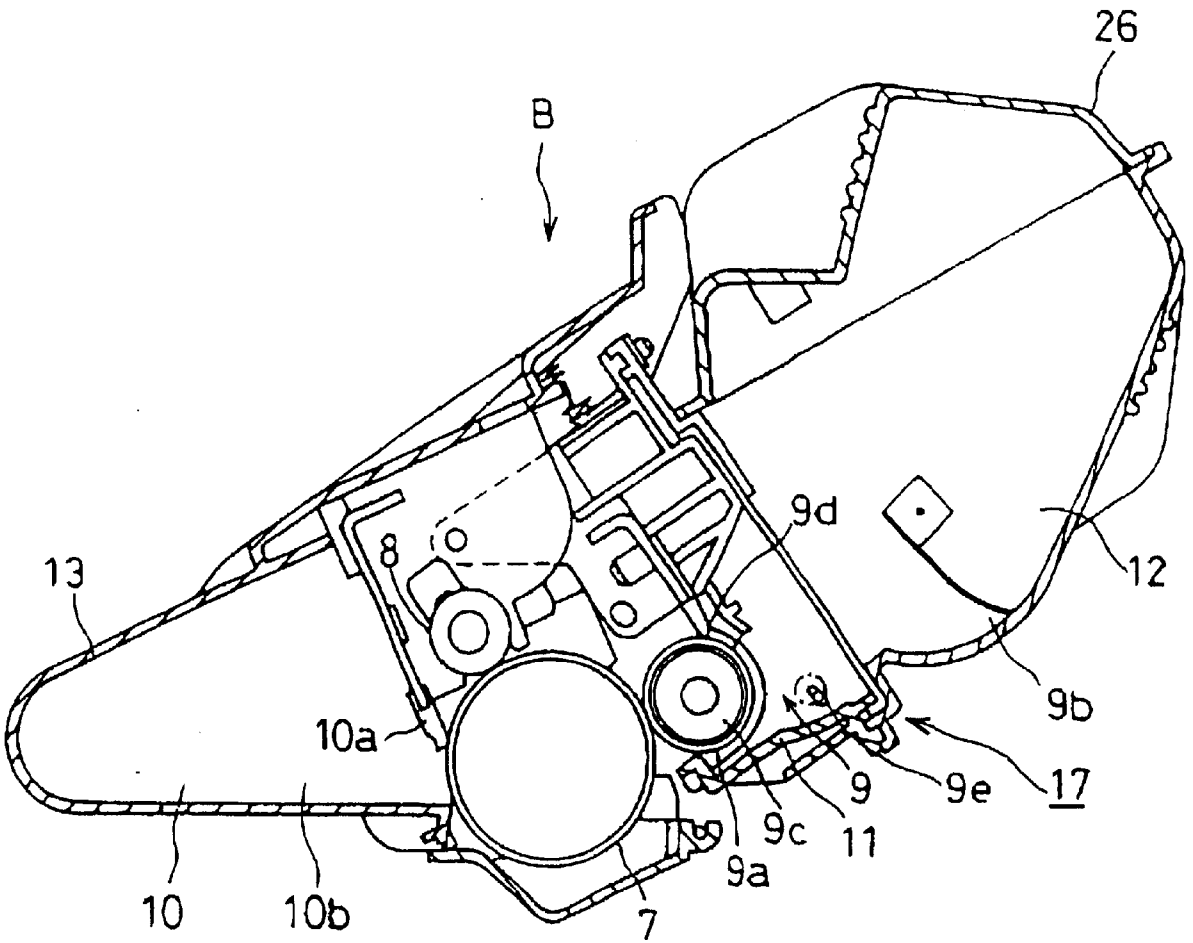
FIG. 2 is a longitudinal sectional view of a process cartridge according to an embodiment of the present invention.

Referring to FIGS. 1 and 2, a description will first be provided as to the process cartridge and the electrophotographic image forming apparatus to which the process cartridge is detachably mountable, according to Embodiment 1 of the present invention.

In this embodiment, the electrophotographic image forming apparatus is a laser beam printer A which forms an image on the recording material through an electrophotographic image forming process. FIG. 1 is a schematic view of the laser beam printer A. FIG. 2 is a substantial longitudinal section of the process cartridge B according to this embodiment of the present invention.

The laser beam printer A comprises an electrophotographic photosensitive member in the form of a drum, namely, a photosensitive drum 7. On the surface of the photosensitive drum 7, an electrostatic latent image is formed by electrostatic latent image forming means. More particularly, the surface of the photosensitive drum 7 is electrically charged by a charge member in the form of a charging roller 8 and is exposed to a laser beam in accordance with image information from a laser diode 1*a* through a polygonal mirror 1*b*, a lens 1*c*, and a reflection mirror 1*d* constituting exposure means, so that the latent image is formed in accordance with image information on the photosensitive drum 7. The electrostatic latent image is developed by developing means 9 into a toner image. In this embodiment, the developing means 9 includes a developing member in the form of a developing roller 9*a* and a developing blade 9*d* for regulating a layer thickness of the developer carried on the developing roller 9*a*. Adjacent to the developer chamber 11, there is provided a developer accommodating container 12 functioning as a developer accommodating portion. The developer is fed out of the developer accommodating container 12 to the developing roller 9*a* in the developer chamber by the rotation of the developer feeding member 9*b*. In the developer chamber 11, there is provided a developer stirring member 9C adjacent to the developing roller 9*a* to circulate the developer in the developer chamber 11. The developing roller 9*a* contains a fixed magnet 9*c* therein. By the rotation of the developing roller 9*a*, the developer is fed. With the feeding, the developer is electrically charged by friction with the developing blade 9*d* (triboelectric charge), and simultaneously formed into a developer layer having a predetermined thickness. The developer is supplied to the developing zone of the photosensitive drum 7. The developer thus supplied to the developing zone is transferred to the latent image on the photosensitive drum 7 to form a toner image. The developing roller 9*a* is connected with a developing bias circuit and is normally supplied with a developing bias voltage which is in the form of an AC biased DC voltage. In this embodiment, the developer is a magnetic developer.

On the other hand, a recording material (paper, an OHP sheet or the like) accommodated in the sheet feeding cassette 3*a* is fed out to the transfer position in synchronism with formation of the toner image by a pick-up roller 3*b* through a pair of feeding rollers 3*c,* 3*d* and a pair of registration rollers 3C. At the transfer position, there is provided a transferring means in the form of a transfer roller 4, and the toner image is transferred from the surface of the photosensitive drum 7 onto the recording material 2 by application of the voltage to the transfer roller 4.

The recording material 2 now having the toner image transferred thereonto is fed to fixing means 5 along a feeding guide 3*f.* The fixing means 5 is provided with a driving roller 5*c* and a fixing roller 5*b* contained a heater 5*a* therein. It fixes the toner image on the recording material 2 by application of heat and pressure on the recording material 2 pressing therethrough.

The recording material 2 is further fed by discharging rollers 3*g,* 3*h,* 3*l* onto a discharging tray 6 through a reverse path 3J. The discharging tray 6 is provided at the top portion of the main assembly 14 of the laser beam printer A. A swingable flapper 3K is operable to discharge the recording material 2 not through the discrimination path 3J but by the pair of discharging rollers 3*m.* In this embodiment, the feeding means is constituted by the pick-up roller 3*b* the pair of feeding rollers 3*c,* 3*d,* the pair of registration rollers 3C, the feeding guide 3*f,* the pair of discharging roller 3*g,* 3*h,* 3*l* and the pair of discharging rollers 3*m.*

The photosensitive drum 7, after the toner image is transferred onto the recording material 2 by the transfer roller 4, is cleaned by cleaning means 10 so that residual toner remaining on the photosensitive drum 7 is removed. Thereafter, the photosensitive drum 7 is prepared for the next image forming process The cleaning means 10 comprises an elastic cleaning blade (cleaning member) 10*a* press-contacted to the photosensitive drum 7 which functions to scrape the residual developer off the photosensitive drum 7 into a residual developer container 10*b.*

In this embodiment, as shown in FIG. 2, the process cartridge B has the following construction. It comprises a developer chamber (first frame portion) 11, a developer accommodating container (second frame portion) 12, and a developer accommodating container cap (cap) (third frame portion) 26, which are welded into an integral part. In the developer accommodating container 12, there is provided a developer feeding member 9*b.* The developer chamber 11 is provided with developing means including a developing roller 9*a* and a developing blade 9*d.* With the developing device frame 17, a cleaning frame 13, provided with a photosensitive drum 7, cleaning means 10 and a charging roller 8, is coupled and by this coupling a process cartridge is constituted.

Figure 3:
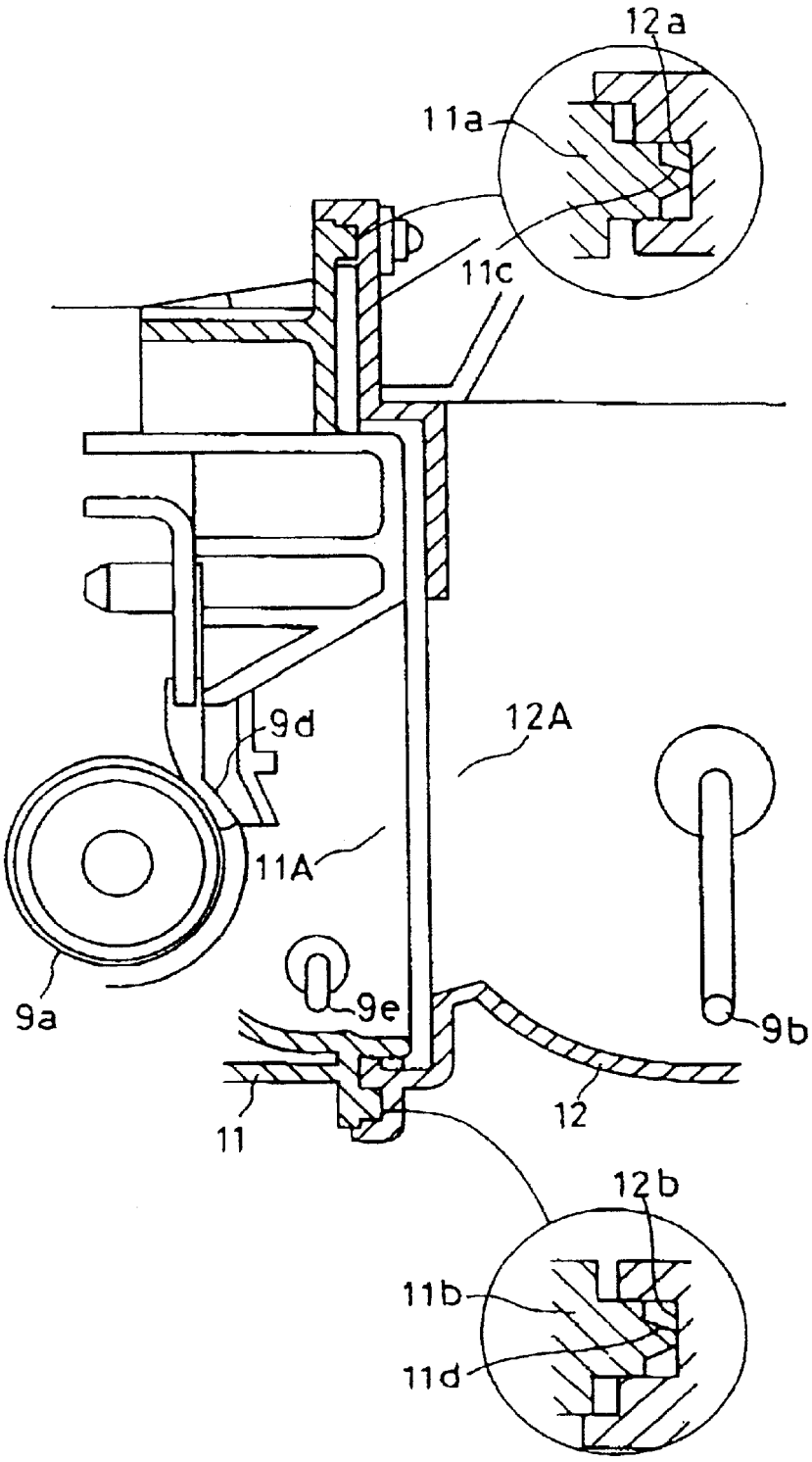
FIG. 3 is an enlarged longitudinal sectional view of a connecting portion between developing device frames according to an embodiment of the present invention.
Figure 4:
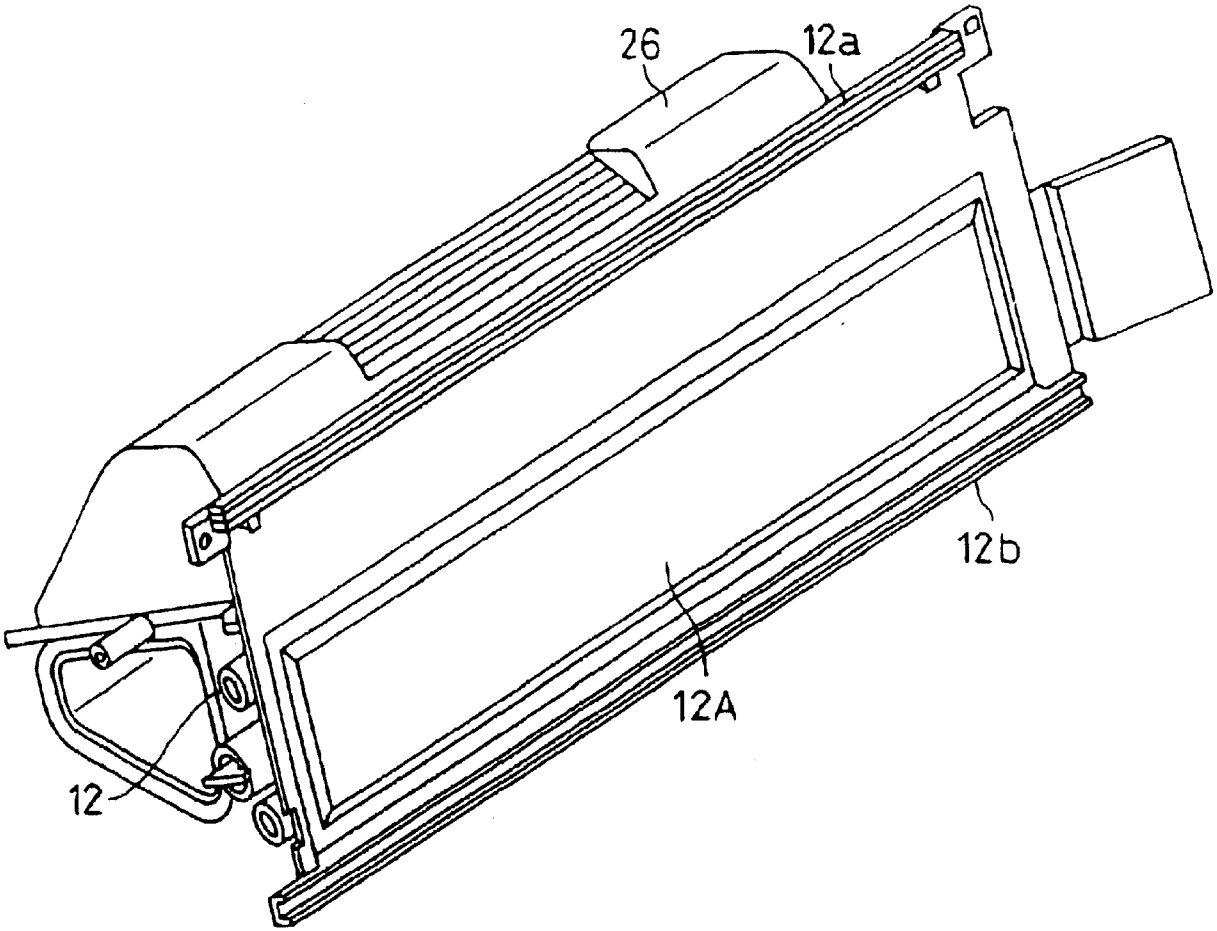
FIG. 4 is a perspective view of a connecting portion of a developer accommodating container according to an embodiment of the present invention.
Figure 5:
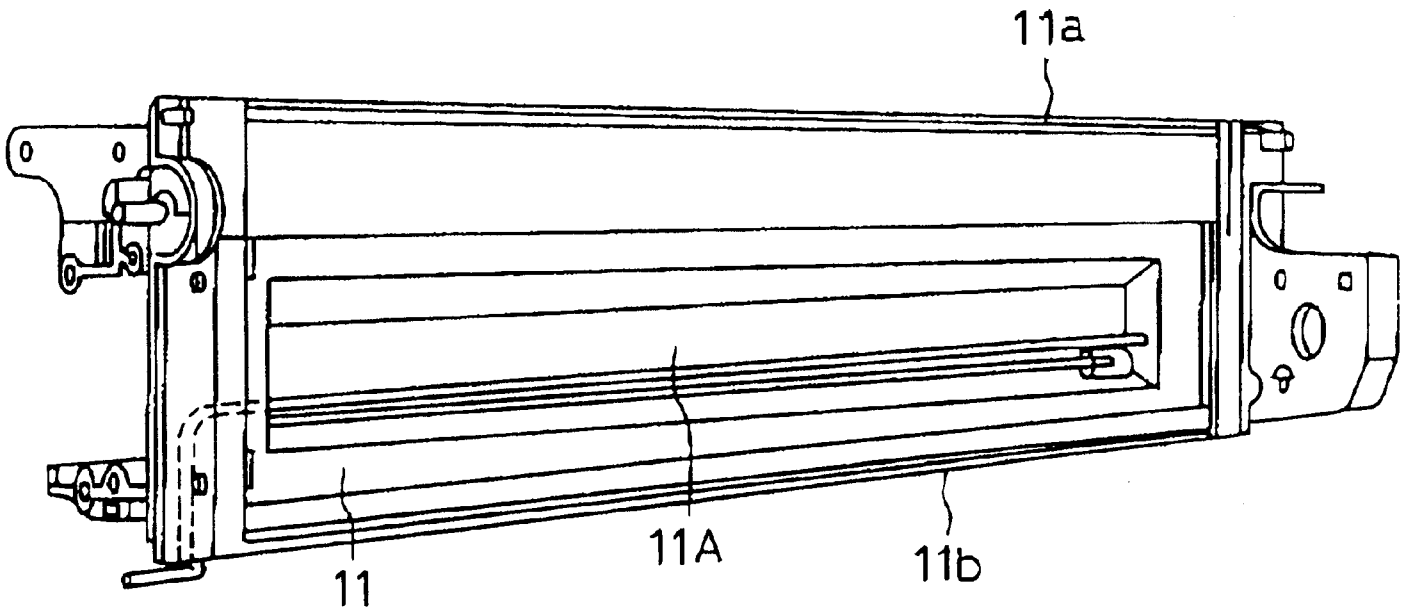
FIG. 5 is a perspective view of a connecting portion of a developer chamber according to an embodiment of the present invention.

As shown in FIGS. 3, 4 and 5 and a connection surface of the developer accommodating container 12 relative to the developer chamber 11 is provided with grooves 12*a,* 12*b* extended in the longitudinal direction at the upper portion and the lower portion of the opening 12A of the developer accommodating container 12 as shown in FIG. 3. The connection surface of the developer chamber 11 relative to the developer accommodating container 12 is provided with projections 11*a,* 11*b* for engagement with the grooves 12*a,* 12*b.* The top surfaces of the projections 11*a,* 11*b* are provided with triangular ribs 11*c,* 11*d* for ultrasonic welding. The recesses 12*a* and 12*b* and projections 11*a,* 11*b* constitute a welding portion between the developer accommodating portion 12 and the developer chamber 11. When the developer accommodating container 12 and the developer chamber 11 are welded with each other, the grooves 12*a,* 12*b* of the developer accommodating container 12 and the projections 11*a,* 11*b* of the developer chamber 11 are engaged with each other after they are provided with respective parts, and the developer chamber 11 and the developer accommodating container 12 are press-contacted to each other. Then, ultrasonic vibration is imparted between the grooves 12*a,* 12*b* and the projections 11*a,* 11*b.* By doing so, the triangle ribs 11*c,* 11*d* are welded with the grooves 12*a,* 12*b* due to the resulting frictional heat, and therefore, developer accommodating container 12 and the developer chamber 11 are fastened to each other.

At the connecting portion between the developer accommodating container 12 and the cap 26, a triangle rib is provided at the cap 26 side. Similarly, the ultrasonic welding is effected using the triangle rib and the connection surface of the developer accommodating container 12.

Figure 6:
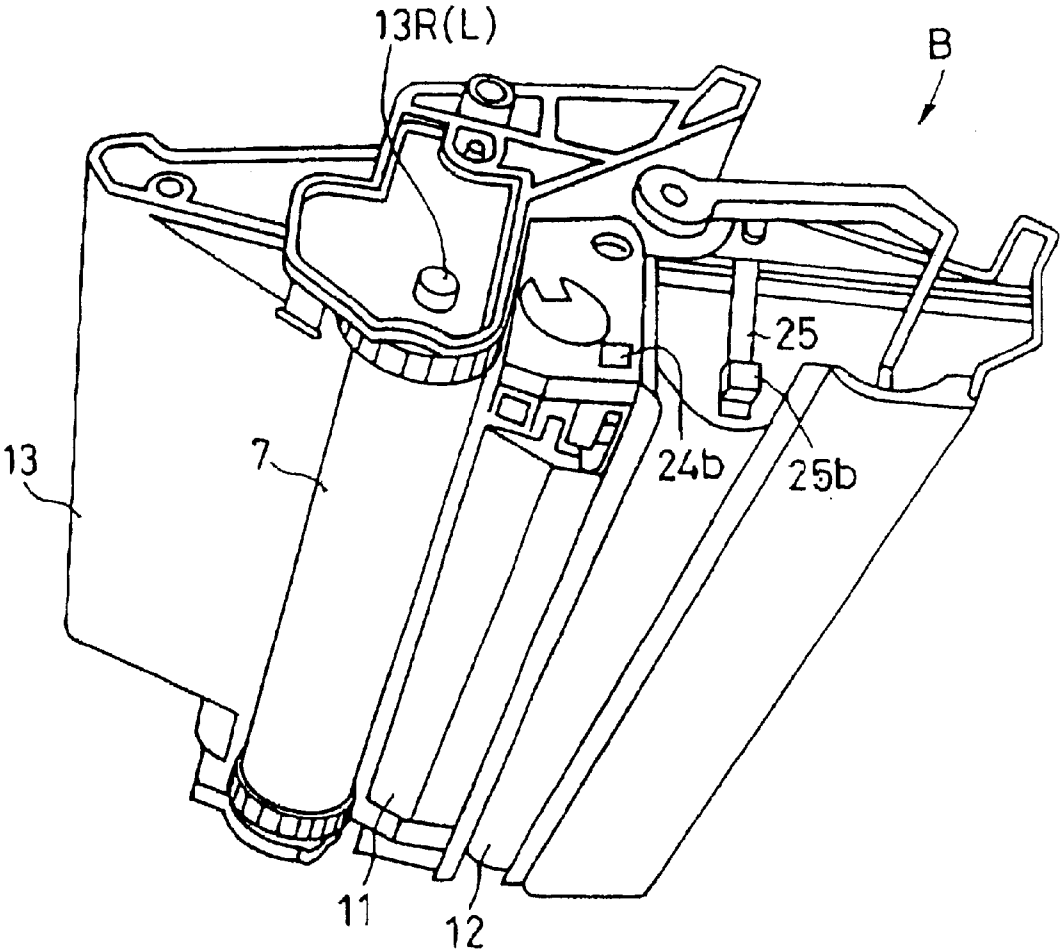
FIG. 6 is a perspective view of the outer appearance of the process cartridge as seen from the bottom side thereof.
Figure 7:
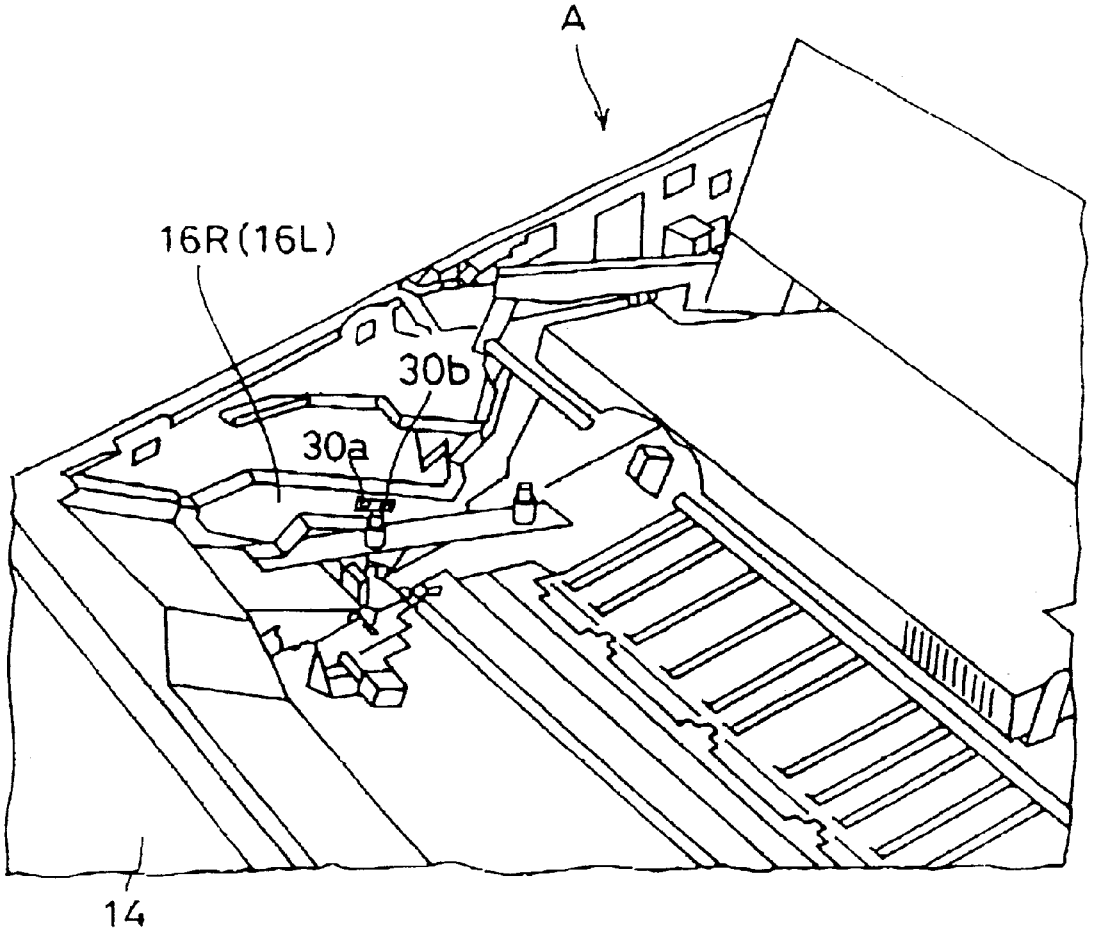
FIG. 7 is a perspective view of an outer appearance of a mounting portion of a main assembly of an apparatus to which the process cartridge is mounted.
Figure 8:
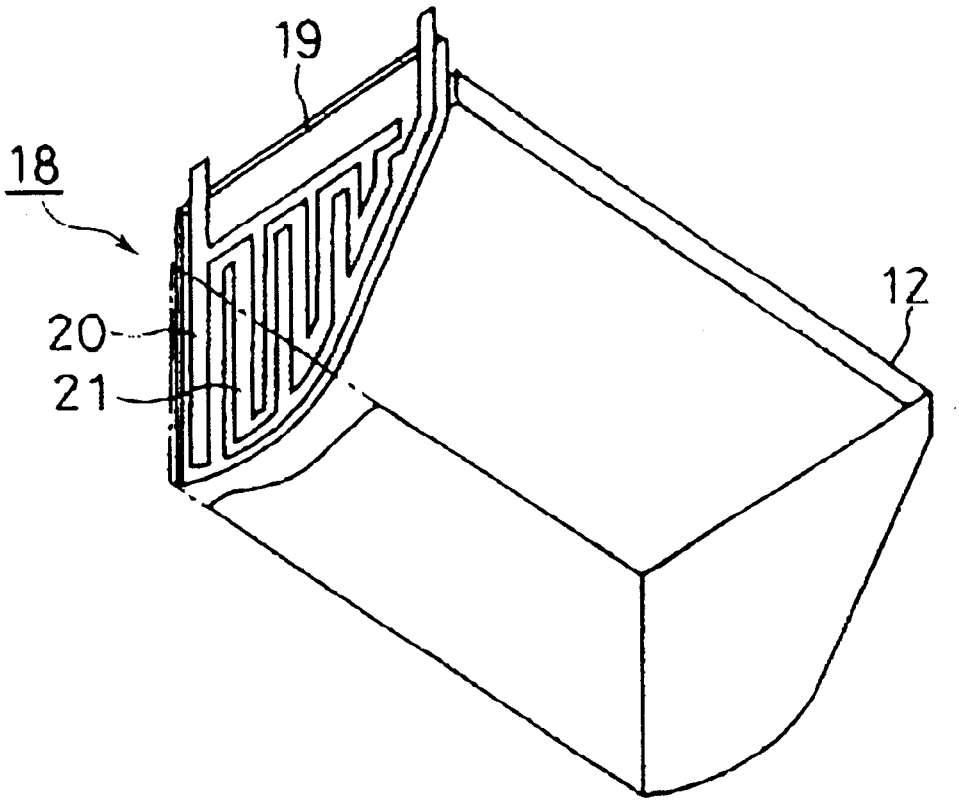
FIG. 8 is a perspective view of a developer accommodating container to illustrate developer amount detecting means according to an embodiment of the present invention.

The process cartridge B is detachably mountable to a cartridge mounting means provided in the main assembly 14 of the image forming apparatus by the user. According to this embodiment, the cartridge mounting means comprises a guide means 13R (13L) (FIG. 6) formed on the outer surface at both sides of the process cartridge B and a guide portion 16R (16L) formed in the main assembly 14 of the apparatus and engageable with the guide means 13R (13L) (FIG. 7). In this embodiment, the process cartridge B is provided with a developer amount detecting means which is capable of detecting substantially in real-time a remaining amount in the developer accommodating container 12 as the developer is consumed from the developer accommodating container 12. FIG. 8 shows the developer amount detecting means used in this embodiment. In this embodiment, the developer amount detecting means has a detection electrode 18 disposed at a position contactable to the developer such as an inner surface or an inner bottom surface of the developer accommodating container 12 such that the contact area relative to the developer changes with a decrease of the developer.

The detection electrode 18 comprises a pair of electroconductive portions, namely, a first electroconductive portion 20 and a second electroconductive portion 21 which are arranged on a substrate 19 at predetermined intervals. The two electroconductive portions 20, 21 are in the form of a number of interlaced combs. The detection electrode 18 detects the electrostatic capacity between the first and second electroconductive portions 20, 21 which constitute a pair of parallel electrodes, by which it detects the amount of the developer in the developer accommodating container 12.

The developer has a larger dielectric constant than the air. Therefore, by the contact of the developer to the surface of the detection electrode 18, the electrostatic capacity between the electroconductive portions 20, 21 increases. Therefore, by the use of the detection electrode 18, a predetermined calibration curve is used to determine the amount of the developer from the area of the developer contacted to the surface of the detection electrode 18 By doing so, the developer amount in the developer accommodating container 12 can be detected irrespective of the cross-sectional configuration of the developer accommodating container 12 or the configuration of the detection electrode 18. In this embodiment, the first electroconductive portion 20 is an output side electrode of the detection electrode, and the second electroconductive portion 21 is an input side electrode of the detection electrode. However, this is riot limiting. The process cartridge B of this embodiment is provided with a connection electrode for the detection electrode 18. More particularly, the process cartridge B is provided with a first contacting electrode (output contact electrode) 24 for supplying the electric signal from the detection electrode 18 to the main assembly of the apparatus and a second contacting electrode (input contact electrode) 25 for receiving from the main assembly 14 of the apparatus an input voltage for the detection electrode 18.

The process cartridge B has a cartridge side contact (cartridge contact)contactable with the main assembly 14 of the apparatus. In this embodiment, as shown in FIG. 6, a first cartridge contact (output contact) 24*b* is provided at one of the ends of the first contacting electrode 24 at one longitudinal end of the process cartridge B, and a second cartridge contact (input contact) 25*b* is provided at one of the ends of the second contacting electrode 25.

The first cartridge contact 24*b* and the second cartridge contact 25*b* are electrically connected with a main assembly side contact (main assembly cartridge contact) provided in the main assembly of apparatus, when the process cartridge is mounted to the main assembly 14 of the apparatus. As shown in FIG. 7, the main assembly 14 of the apparatus is provided with a main assembly input contact (second main assembly cartridge contact) 30*a* and a main assembly output contact (first main assembly cartridge contact) 30*b*.

The main assembly side contacts 30*a*, 30*b* are electrically connectable with the first cartridge contact 24*a* and the second cartridge contact 25*b*. Through the respective contacts, the voltage is applied to the second electroconductive portion 21 of the detection electrode 18, and the detection signal is outputted from the first electroconductive portion 20. In the main assembly 14 of the apparatus, the remaining amount of the developer is displayed substantially in real-time in accordance with the signal on a display screen of the main assembly 14 or external equipment such as a computer connected for communication with the main assembly 14 of the apparatus.

In this embodiment, the first cartridge contact 24*b* is provided on the outer surface of the developer chamber (first frame portion) 11. The second cartridge contact 25*b* is mounted on the outer surface of the developer accommodating container (second frame portion) 12. Therefore, the first electroconductive portion (output side electrode) 20 of the detection electrode 18 has to be connected from the developer accommodating container 12 through the developer container 12.

Figure 9:
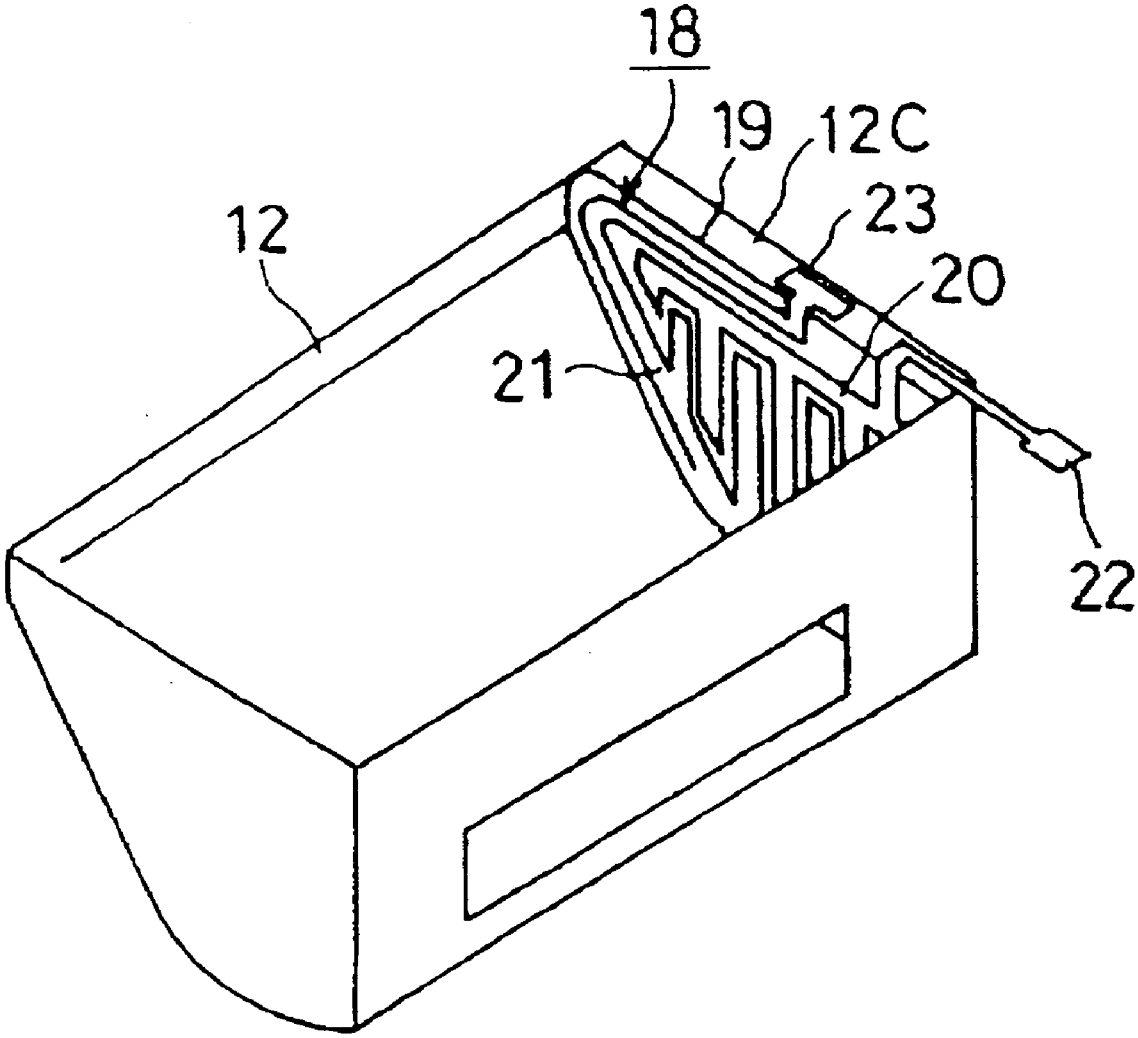
FIG. 9 is a perspective view of a developer accommodating container to illustrate developer amount detecting means according to an embodiment of the present invention.
Figure 10:
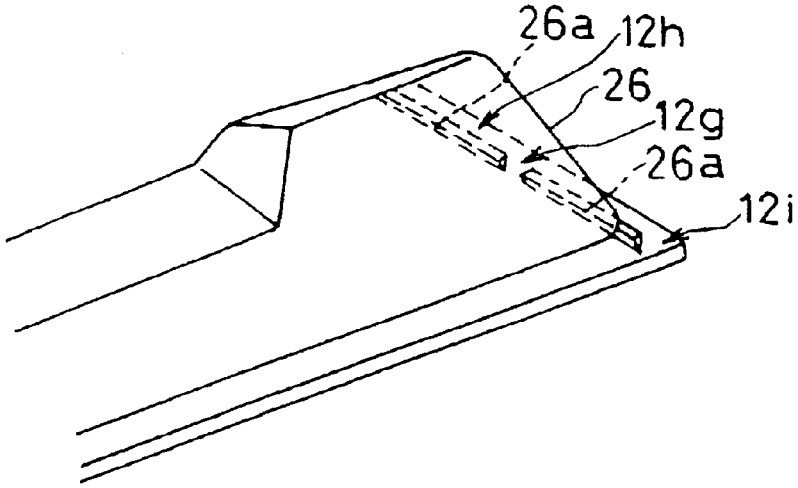
FIG. 10 is an enlarged perspective view of the developer accommodating container and a developer accommodating container cap to illustrate the connection of the developer amount detecting means according to an embodiment of the present invention.
Figure 10:
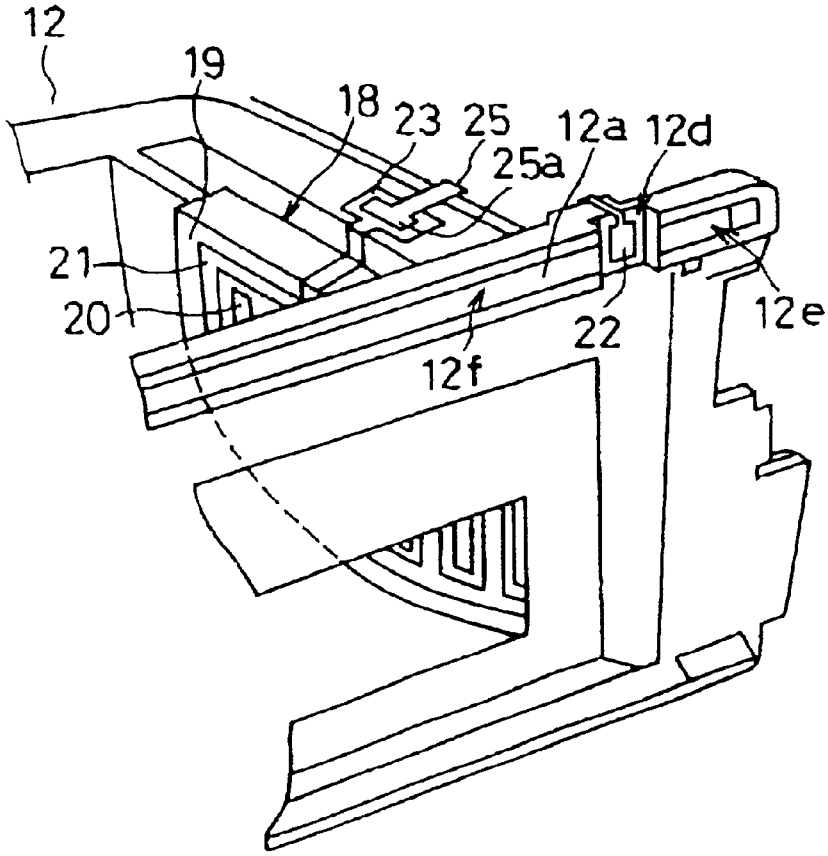
Figure 11:
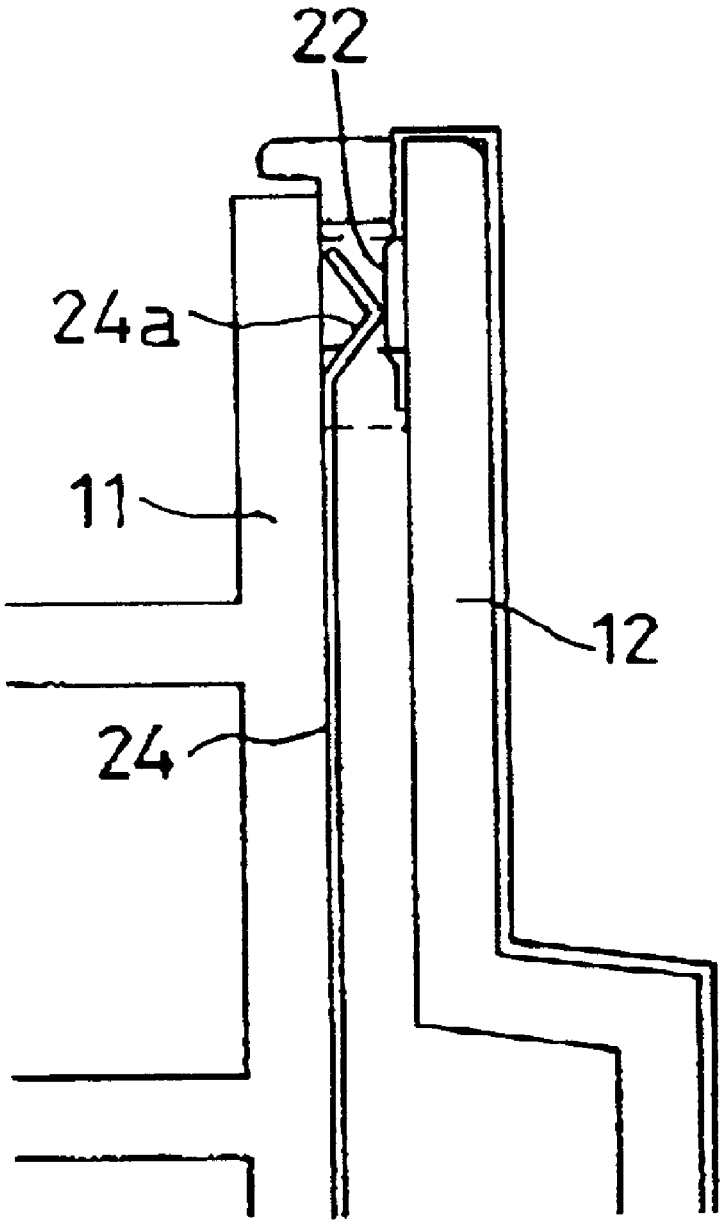
FIG. 11 is an enlarged longitudinal sectional view of a connecting portion between the developer chamber and the developer accommodating portion according to an embodiment of the present invention.

Referring to FIGS. 9 through 11, a description will be provided as to the electrical connection of the detection electrode 18. In this embodiment, as shown in FIG. 9, from the substrate 19 on which the detection electrode 18 is provided, a first electroconductive portion contact 22, electrically connected with the first electroconductive portion 20 of the detection electrode 18, and a second electroconductive portion contact 23, electrically connected with the second electroconductive portion 21, are projected out. In this embodiment, the first electroconductive portion contact 22 and the second electroconductive portion contact 23 are integral with the first electroconductive portion 20 and the second electroconductive portion 21, respectively.

A description will be provided as to the connecting portion of the first electroconductive portion contact 22 of the detection electrode 18. As shown in FIGS. 10 and 11, the first electroconductive portion contact 22 is contacted to and therefore is electrically connected with the first contacting electrode 24 at the connecting portion between the developer chamber 11 and the developer accommodating container 12. At one end of the first contacting electrode 24, a contact portion 24*a* is provided and is contacted into the first electroconductive portion contact 22.

Here, as described hereinbefore, the developer accommodating container 12 is provided with a groove 12a for welding between the developer accommodating container 12 and the developer chamber 11. The first electroconductive portion contact 22 is at such a position as corresponds to the groove 12*a* partly cut away. The contact portion 24*a* is disposed at such a position that projection 11*a* having the triangle rib 11*c* (welding portion of the developer chamber) is partly cut away.

Thus, the welding portion between the developer accommodating container 12 and the developer chamber 11 has a first welded portion 12*e* and a second welded portion 12*f* which are disposed spaced in the longitudinal direction of the developer accommodating container 12. The contact portion between the first electroconductive portion contact 22 and the output contact 24*a* is disposed in the space portion 12*d* therebetween, As shown in FIG. 11, when the developer chamber 11 and the developer accommodating container 12 are fastened with each other by ultrasonic welding, the contact portion 24*a* and the first electroconductive portion contact 22 are press contacted to each other, between the developer accommodating container 12 and the developer chamber 11, by which an electrical connection is established therebetween.

In this embodiment, the first contacting electrode 24 is thin. The contact portion 24*a* is deformed into a height of the triangle rib 11*c* provided at a top surface of the projection 11*a* or a little bit higher than that toward the developer accommodating container 12. The deformed contact portion 24*a* is sandwiched between the developer chamber 11 and the developer accommodating container when the projection 11*a* and the groove 12*a* are connected with each other by the ultrasonic welding. By doing so, the contact portion 24*a* is assuredly press-contacted to the first electroconductive portion contact 22.

In this manner, the first electroconductive portion contact 22 and the contact portion 24*a* are sandwiched and contacted at the space portion 12*d* in the continuous welded portions 12*e*, 12*f* between the developer accommodating container 12 and the developer chamber 11. By doing so, the two electrodes are surely contacted to each other, so that a conduction defect duty shortage of contact pressure can be avoided.

A description will be provided as to the connecting portion of the second electroconductive portion contact 23. As shown in FIG. 10, the second electroconductive portion contact 23 is contacted to and electrically connected with the second contacting electrode 25 at the connecting portion between the developer accommodating container 12 and the cap 26. At one end of the second contacting electrode 25, a contact portion 25*a* is provided and is contacted to the first electroconductive portion contact 23.

Here, a surface of the cap 26 is provided with the triangle rib 26*a* at the welded portion relative to the developer accommodating container 12, as described hereinbefore. However, there is no triangle rib 26*a* at the portion where the second electroconductive portion contact 23 is contacted to the contact portion 25*a*. By doing so, the welding portion between the developer accommodating container 12 and the cap 26, comprises a first welded portion 12*h* and a second welded portion 121 which are disposed spaced from each other in a direction perpendicular to the longitudinal direction of the developer accommodating portion 12. The space portion 1*g* is the contact portion between the second electroconductive portion contact 23 and the contact portion 25*a*.

When the developer accommodating container 12 and the cap 26 are welded with each other, the second electroconductive portion contact 23 and the contact portion 25*a* are sandwiched and a press-contacted between the developer accommodating container 12 and the cap 26.

In this manner, the second electroconductive portion contact 23 and the contact portion 25*a* of the first contacting electrode are sandwiched and contacted at the welded portions 12*h*, 12*l* between the developer accommodating container 12 and the cap 26. By doing so, the two electrodes are surely contacted to each other, so that a conduction defect duty shortage of contact pressure can be avoided.

Thus, according to this embodiment, the electric connection within the process cartridge is assured. Therefore, the voltage receivable by a process cartridge from the main assembly of the apparatus can be assuredly supplied to the predetermined member. Thus, the electric wiring can be assured across the frames.

Embodiment 2

A description will be provided as to a second embodiment. The fundamental structure of the image forming apparatus of this embodiment is the same as that of Embodiment 1, except for the developer amount detecting means and the connecting structures. Therefore, the same reference numerals are assigned to corresponding elements.

Figure 12:
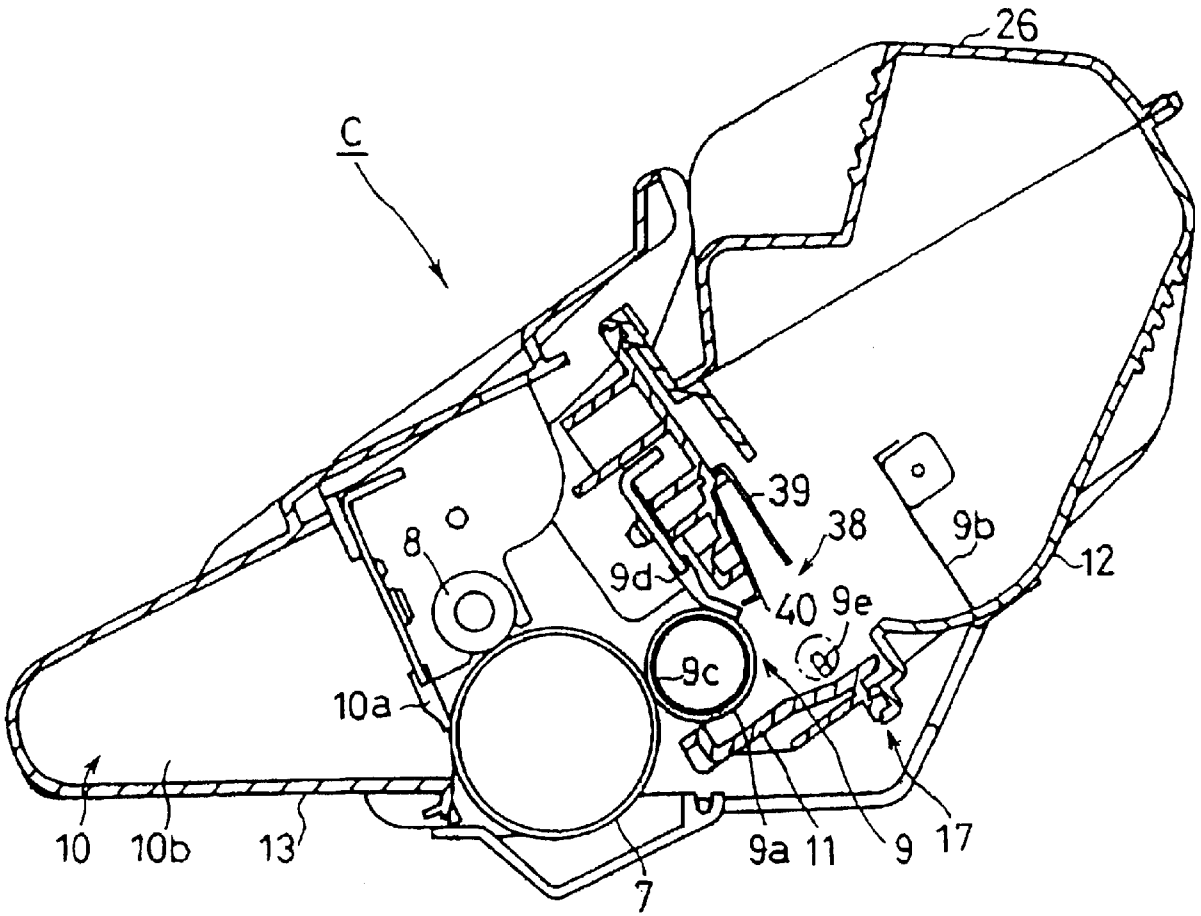
FIG. 12 is a longitudinal sectional view of a process cartridge according to another embodiment of the present invention.

FIG. 12 is a schematic longitudinal sectional view of the process cartridge C according to this embodiment. The structural frames of the process cartridge are the same as with Embodiment 1. It comprises a developer chamber (first frame portion) 11, a developer accommodating container (second frame portion) 12, and a developer accommodating container cap (cap) (third frame portion) 26, which are welded into an integral part. In the developer accommodating container 12, there is provided a developer feeding member 9*b*. The developer chamber 11 is provided with developing means including a developing roller 9*a* and a developing blade 9*d*. With the developing device frame 17, a cleaning frame 13, provided with a photosensitive drum 7, cleaning means 10 and a charging roller 8, is coupled and by this coupling a process cartridge is constituted.

The developing device frame 17 of the process cartridge C is welded by ultrasonic welding in the same manner as with Embodiment 1. More particularly, the developer chamber 11 is provided with a projection 11*a* (11*b*) having a triangle rib 11*c* (11*d*). The developer accommodating container 12 is provided with a groove 12*a* (12*b*). The cap 26 is provided with a triangle rib 26*a*.

In this embodiment, the process cartridge C is provided with a developer amount detecting means which is capable of detecting substantially in real-time a remaining amount in the developer accommodating container 12 as the developer is consumed from the developer accommodating container 12.

In this embodiment, as shown in FIG. 12, the developer amount detecting means comprises a first electroconductive portion 39 and a second electroconductive portion 40 in the form of plates as a detection electrode constituting a developer detection portion 38. The first and second electroconductive portions 39, 40 are arranged along the length of the developing roller 9*a*. A voltage is applied to one of first electroconductive portion 39 and the second electroconductive portion 40, so that an electrostatic capacity is induced between the electroconductive portions 39, 40. The amount of the developer is detected by detecting the electrostatic capacity.

In this embodiment, the voltage is applied to the first electroconductive portion 39. Thus, the first electroconductive portion 39 is an input electrode of the detection electrode, and the second electroconductive portion 40 is an output electrode thereof. However, this is not limiting.

A magnetic developer used in this embodiment is attracted to the surface of the developing roller by the magnetic force provided by the fixed magnet 9*c* in the developing roller 9*a*. The developer is scraped off the developing roller by the developing blade 9*d* during rotation of the developing roller 9*a* and is made uniform on the surface of the developer roller 9*a*.

The first and second electroconductive portions 39, 40 are disposed such that developer removed from the surface of the developing roller 9*a* enters between the electroconductive portions 39, 40.

Since the dielectric constant of the developer is higher than that of the air, the electrostatic capacity is larger when the developer exists between the first and the second electroconductive portions 39, 40. When the amount is large in the developer chamber 11, the removed developer sequentially enters between the first and second electroconductive portions 39, 40. Therefore, the outputted electrostatic capacity is always large. With the consumption of the developer from the developer chamber 11, the amount of the developer entering between the first and second electroconductive portions 39, 40 decreases. Correspondingly, the electrostatic capacity decreases, too. Thus, the developer amount detecting means detects substantially in real time the amount of the developer by detecting the electrostatic capacity.

Figure 13:
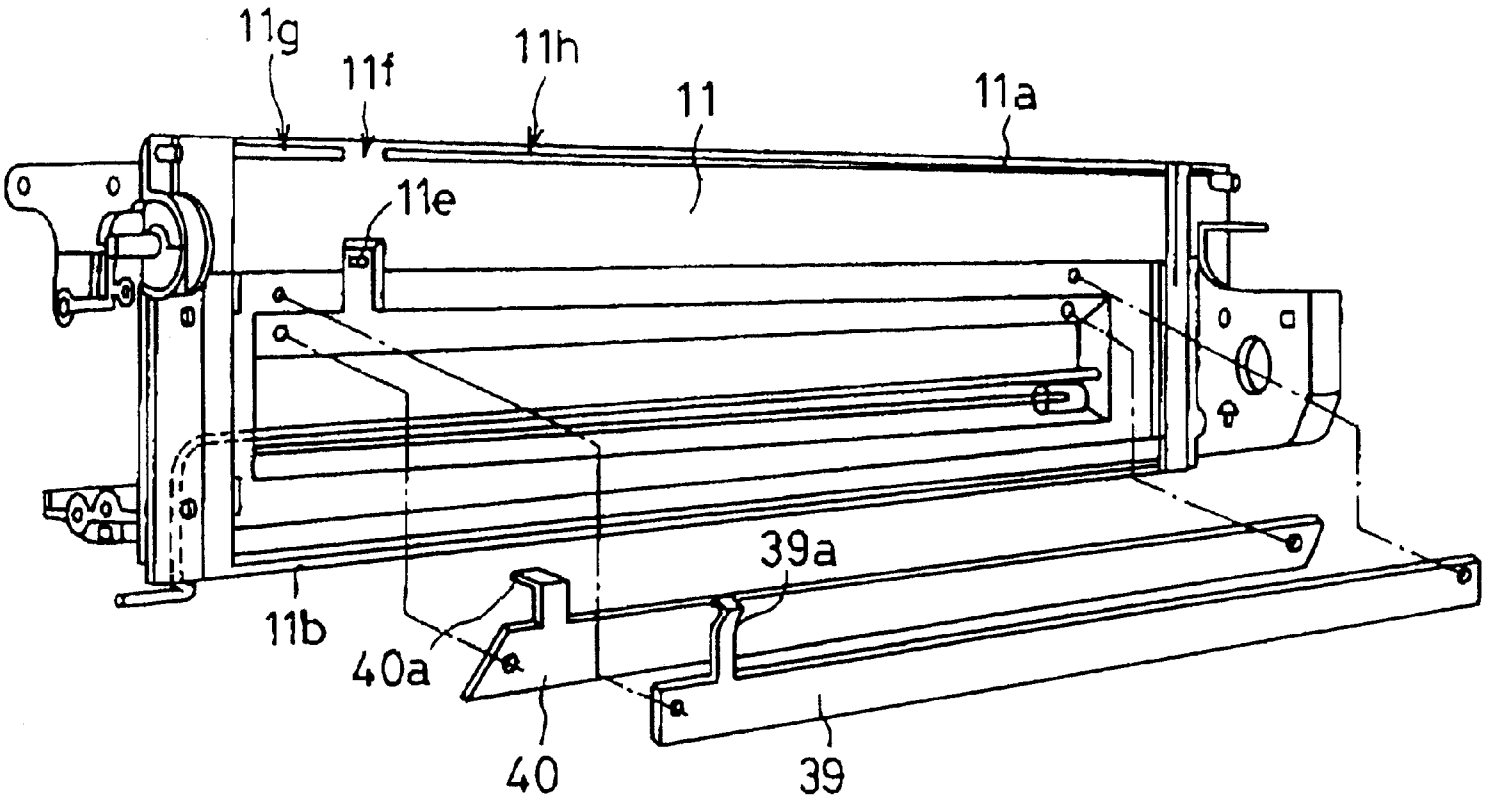
FIG. 13 is a perspective view of a connecting portion of the developer chamber according to another embodiment of the present intention.
Figure 14:
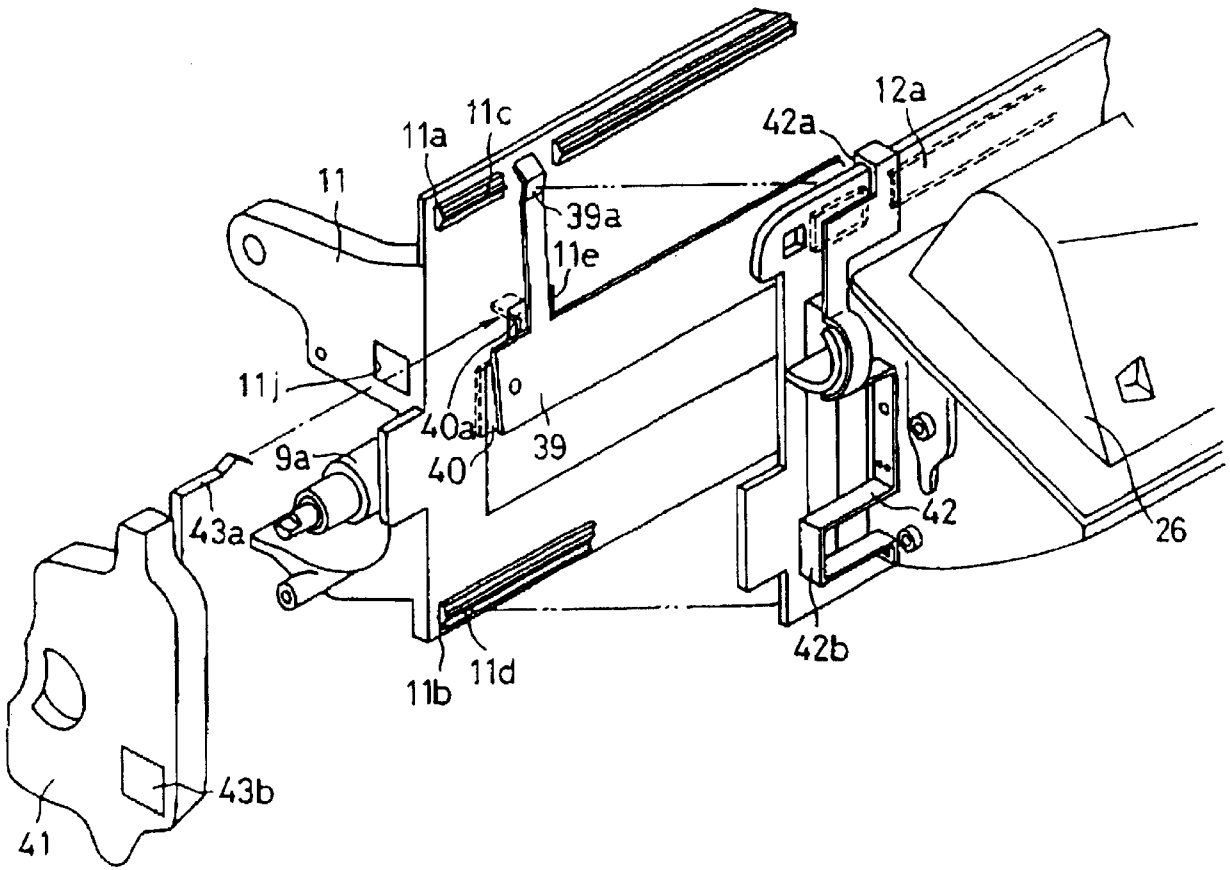
FIG. 14 is an enlarged perspective view of the developer chamber and the developer accommodating container to illustrate a connection of developer amount detecting means according to another embodiment of the presentation.
Figure 15:
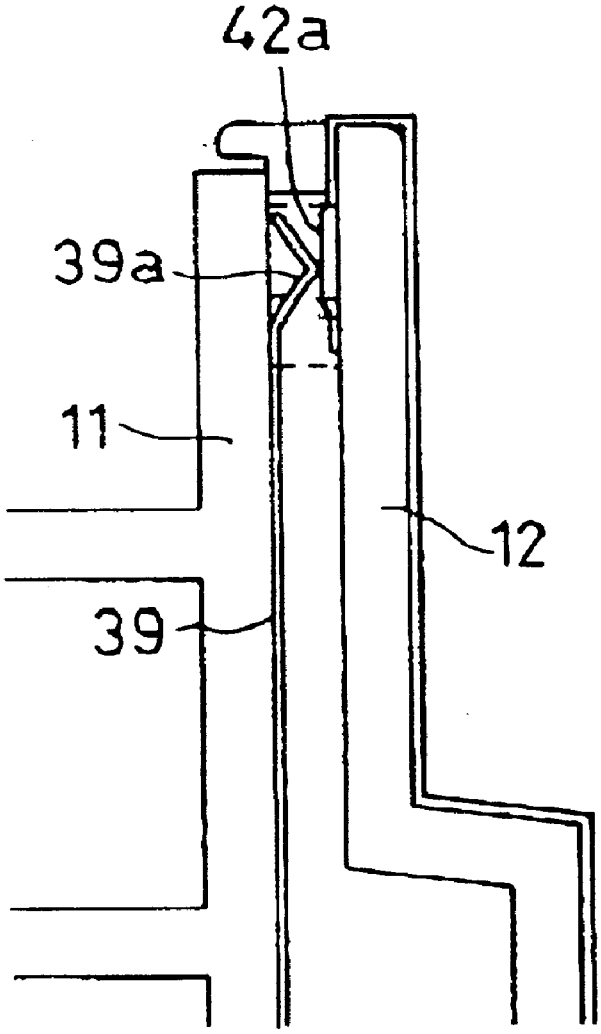
FIG. 15 is an enlarged longitudinal sectional view of a connecting portion between the developer chamber and the developer accommodating portion according to a further embodiment of the present intention.

Referring to FIGS. 13 through 15, a description will be provided as to the connecting manner of the developer amount detecting means.

As shown in FIGS. 13 through 14, the first electroconductive portion 39 and the second electroconductive portion 40 are mounted to the developer chamber 11.

The first electroconductive portion 39 has an integral first electroconductive portion contact 39*a* extending in the direction perpendicular to the longitudinal direction thereof. A free end of the first electroconductive portion contact 39*a* is disposed so as to correspond to a partly cutaway portion of a projection 11*a* (welded rib) provided in the developer chamber 11 when the first electroconductive portion 39 is mounted to the developer chamber 11. In this embodiment, the free end portion of the first electroconductive portion contact 39*a* provided in the first electroconductive portion 39 is deformed into a projection extending in a connecting direction relative to the developer accommodating container 12 so as to have substantially the same height as the triangle rib 11*c* provided on the top surface of the projection 11*a* or a little bit higher than that.

The developer accommodating container 12 to be welded with the developer chamber 11, as shown in FIG. 14, is provided with a first contacting electrode (input contact electrode) 42 as a connection electrode for the detection electrode. Most of the part of the first contacting electrode 42 is provided outside the developer accommodating container 12. At one end of the first contacting electrode 42, there is provided one of the contact portions (folded-back portion) 42*a* of the first contacting electrode 42. The folded back portion 42*a* is disposed at the connecting portion between the developer accommodating container 12 and the developer chamber 11. The folded back portion 42*a* is disposed such as to correspond to the partly cut-away portion of the upper groove 12*a* of the developer accommodating container 12 in the figure. In this manner, the folded back portion 42*a* (one of the contact portions of the first contacting electrode 42) is exposed to the welding portions side relative to the developer chamber 11.

The welding portion between the developer accommodating container 12 and the developer chamber 11 comprises a first welded portion 11*g* and a second welded portion 11*h* which are disposed to be spaced from each other in the longitudinal direction. The contact portion between the projection 39*a* and the folded back portion 42*a* is disposed corresponding to the clearance portion 11*f*.

The folded back portion 42*a* is contacted to and electrically connected with the first electroconductive portion contact 39*a* mounted on the developer chamber 11.

As shown in FIG. 15, the free end of the first electroconductive portion contact 39*a* (projection) is sandwiched between the developer chamber 11 and the developer accommodating container 12 when the developer chamber 11 and the developer accommodating container 12 are fastened by ultrasonic welding. By doing so, the first electroconductive portion contact 39*a* is assuredly press-contacted to the folded back portion 42*a* provided in the developer accommodating container 12.

One longitudinal end surface of the process cartridge is provided with a cartridge side contact (cartridge contact) which is contactable to a contact provided in the main assembly of apparatus. More particularly, one of the ends of the first contacting electrode 42 has a first cartridge contact (input contact) 42*b*. The cartridge side input contact 42*b* is electrically contactable to the main assembly side contact (main assembly cartridge contact) when the process cartridge C is mounted to the main assembly 14 of apparatus. In this embodiment, the first cartridge contact 42*b* is electrically contactable to the main assembly input contact (first main assembly cartridge contact) 30*a* provided in the main assembly 14 of apparatus.

A voltage (bias) is applied to the first electroconductive portion 39 through the first contacting electrode 42 from the contact 30*a* (FIG. 7) provided in the main assembly 14 of the apparatus.

On the other hand, the second electroconductive portion 40 is provided with an integral second electroconductive portion contact 40*a*. The second electroconductive portion contact 40*a* extends to project out of the surface of the plate of the second electroconductive portion 40 and is bent When the second electroconductive portion 40 is mounted to the developer chamber 11, the second electroconductive portion contact 40*a* is inserted through a through-opening 11*e* formed in the developer chamber 11. By doing so, the second electroconductive portion contact 40*a* is projected through the through hole 11*e*.

One longitudinal end of a surface of the process cartridge (end portion of the developer chamber 11) is provided with an end cover 41 fixed thereto, the end cover 41 functioning to rotatably support the developing roller by way of a bearing. The end cover 41 is provided with a second contacting electrode (output contact electrode) 43 (connection electrode) fixed thereto. A contact portion 43*a* formed at one of the ends of the second contacting electrode 43 provided on the end cover 41, is electrically connected with the second electroconductive portion contact 40*a* through the opening 118 when the end cover 41 is mounted to the side of the developer chamber 11.

The end cover 41 is provided with a second cartridge contact (output contact) 43 at the other end of the second contacting electrode 43. The second cartridge contact 43*b* is fixed on the outer surface of the end cover 41 and is exposed to the outside. The contact portion 43*b* is electrically connected to the main assembly output contact (second main assembly cartridge contact) 30*b* (FIG. 7) provided in the main assembly 14 of the apparatus when the process cartridge C is mounted to the main assembly 14 of apparatus.

In this embodiment, a signal corresponding to the electrostatic capacity between the first and second electroconductive portions 39, 40 is outputted to the main assembly 14 of the apparatus through the second contacting electrode 43.

In the main assembly 14 of the apparatus, the remaining amount of the developer is displayed substantially in real-time in accordance with the signal on a display screen of the main assembly 14 or external equipment such as a computer connected for communication with the main assembly 14 of the apparatus.

According to this embodiment, the first contacting electrode 42 and the first electroconductive portion 39 are sandwiched and contacted to each other at the space portion 11*f* of the continuous welding portions 11*g* and 11*h* between the developer accommodating container 12 and the developer chamber 11. By doing so, they are surely contacted between the developer chamber 11 and the developer accommodating container 12 so as to avoid improper contact or the like.

Thus, according to this embodiment, the electric connection within the process cartridge is assured. Therefore, the voltage receivable by a process cartridge from the main assembly of the apparatus can be assuredly supplied to the predetermined member. Thus, the electric wiring can be assured across the frames.

Embodiment 3

A description will be provided as to a third embodiment. The fundamental structures of the image forming apparatus and the process cartridge are the same as with Embodiment 2. This embodiment is different therefrom only in the connection of the developer amount detecting means. Therefore, the detailed description thereof is performed by assigning the same reference numerals to the elements having the corresponding functions.

The structure of the frames of the process cartridge is the same as with Embodiment 2. In this embodiment, the frames are welded by ultrasonic welding.

Figure 16:
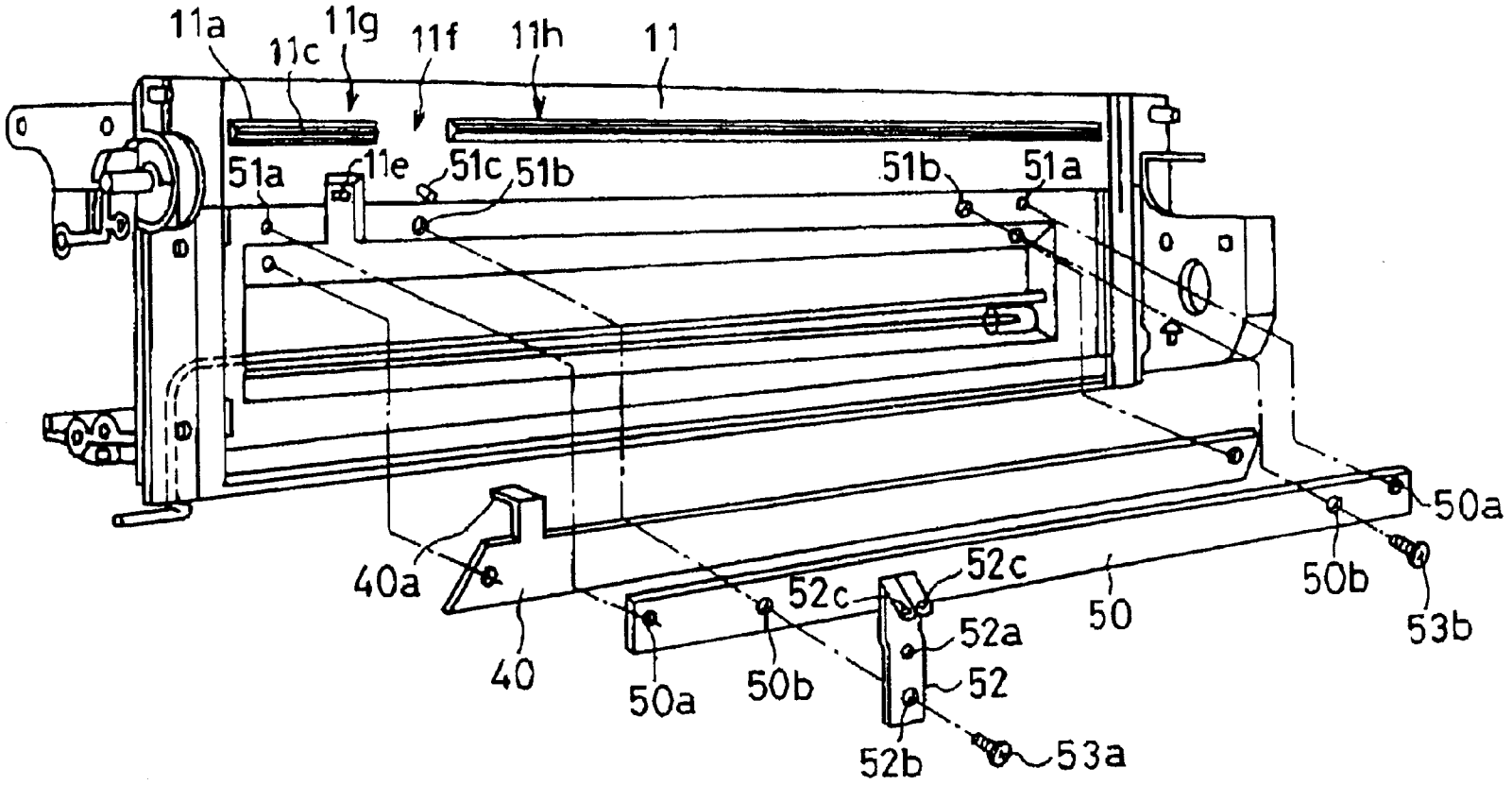
FIG. 16 is a perspective view of a connecting portion of the developer chamber according to a further embodiment of the present intention.
Figure 17:
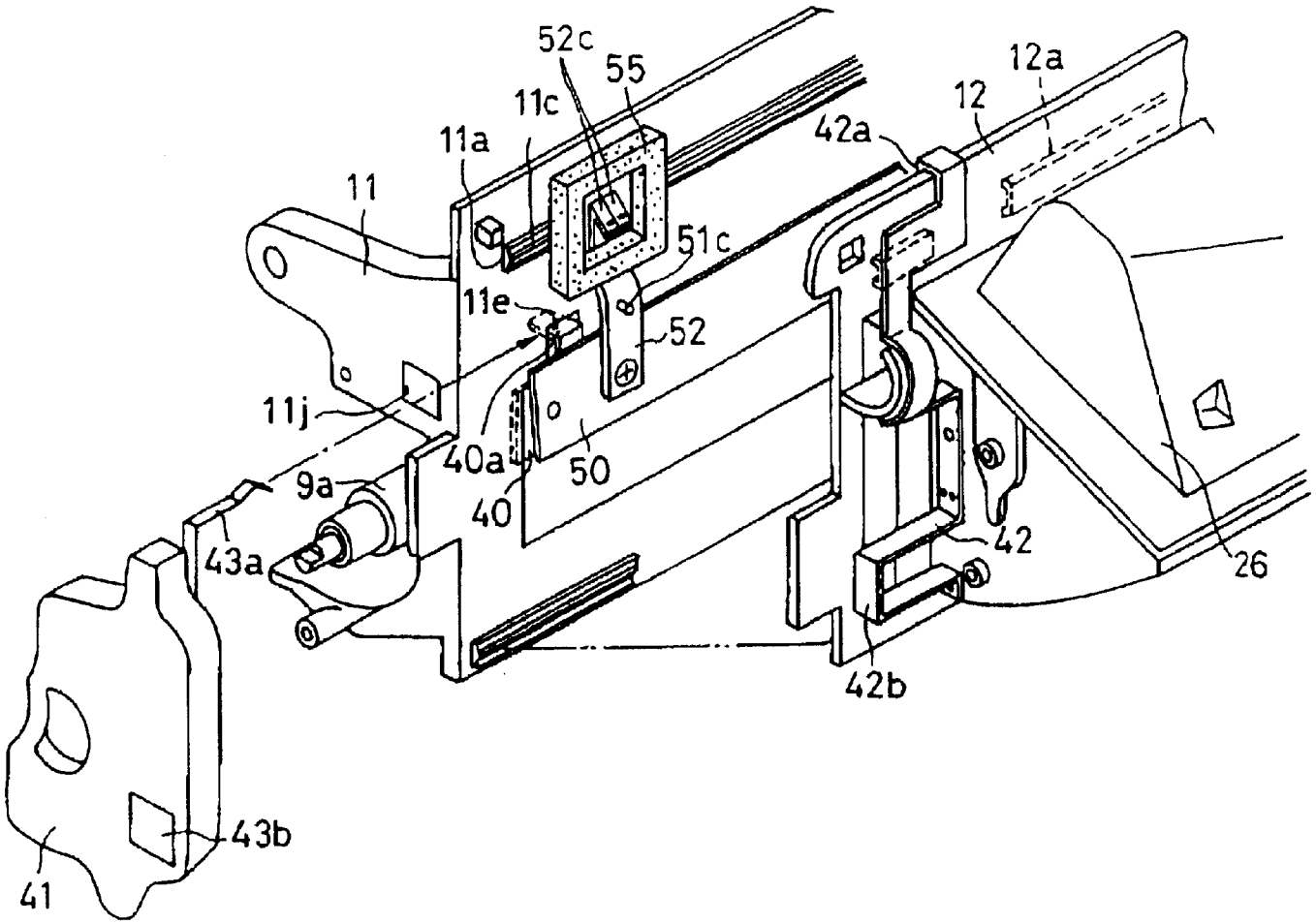
FIG. 17 is an enlarged perspective view of the developer chamber and the developer accommodating container to illustrate the connection of the developer amount detecting means according to a further embodiment of the presentation.

The process cartridge of this embodiment is provided with a plate-like first electroconductive portion 50 and second electroconductive portion 40 as developer amount detecting means. As shown in FIGS. 16 and 17, the first electroconductive portion 50 and the second electroconductive portion 40 are mounted to the developer chamber 11. In this embodiment, too, the first electroconductive portion 50 is an input side electrode of the detection electrode, and the second electroconductive portion 40 is an output side electrode of the detection electrode. The detection principle for the amount of the developer by the developer amount detecting means is the same as with Embodiment 2.

A description will be provided as to the connection of the developer amount detecting means. The first electroconductive portion 50 is correctly positioned by engagement between positioning holes 50*a* provided at both of the longitudinal ends and positioning bosses 51*a*, 51*a*.

They are fastened by threading screws 53*a*, 53*b* into screw bores 51*b*, 51*b* of the developer chamber (first frame portion) through holes 50*b*, 50*b*.

When the first electroconductive portion 50 is fastened to the developer chamber 11, one (screw 53*a* (left side in FIG. 16)) of the screws also fastens the electrode plate 52 which functions as the first electroconductive portion contact.

The electrode plate 52 functions to electrically connect the first electroconductive portion 50 and the first contacting electrode (input contact electrode) 42 mounted to the developer accommodating container 12. The electrode plate 52 is correctly positioned by engagement between the positioning hole 52*a* and the positioning boss 51*c* of the developer chamber 11. Thereafter, by threading the small screw 53*a* into the hole 52*b*, it is fastened and is simultaneously electrically connected with the first electroconductive portion.

A free end of the electrode plate 52 is folded back. In this embodiment, the free end is bifurcated. Each of the bifurcated ends is provided with a contact portion 52*c* having an emboss (projection) which functions as a contact with the first contacting electrode 42. In this embodiment, the first electroconductive portion 50 and the second electroconductive portion 40 are made of non-magnetic SUS material steel so as to avoid an influence against circulation of the developer in the developer chamber 11. The electrode plate 52 is disposed at a position away from the developer chamber 11, where the developer does not circulate, and is made of phosphor bronze, which is proper for electrical connection.

The contact portion 52*c* is disposed corresponding to a cutaway portion of the projection 11*a* (welded rib) having the triangle rib 11*c* provided in the developer chamber 51.

To the developer accommodating container (second frame portion) 12, as shown in FIG. 17, the first contacting electrode 42 as the connection electrode for the detection electrode is mounted.

The structure of the contacting electrode 42 is similar to embodiment. Most of the part of the first contacting electrode 42 is outside the developer accommodating container 12. At one end of the first contacting electrode 42, there is provided one of the contact portions (folded-back portion) 42*a* of the first contacting electrode 42. The folded back portion 42*a* is disposed at the connecting portion between the developer accommodating container 12 and the developer chamber 11. The folded back portion 42*a* is disposed such as to correspond to the partly cut-away portion of the upper groove 12*a* of the developer accommodating container 12 in the figure. In this manner, the folded back portion 42*a* (one of the contact portions of the first contacting electrode 42) is exposed to the welding portions side relative to the developer chamber 11.

The welding portion between the developer accommodating container 12 and developer chamber 11 comprises a first welded portion 11*g* and a second welded portion 11*h,* which are disposed to be spaced from each other in the longitudinal direction. The contact portion between the projection 39*a* and the folded back portion 42*a* is disposed corresponding to the clearance portion 11*f.*

In this embodiment, the first electroconductive portion 50 and the electrode plate 52 are mounted to the developer chamber 11, and thereafter, the seal member 55 is mounted so as to enclose the contact portion 52*c* of the electrode plate 52. The seal member 55 functions to prevent developer leakage through the cutaway portion of the welded rib 11*a*. In this embodiment, the seal member 55 is made of sponge-like material having an elasticity.

The developer chamber 11 and the developer accommodating container 12 which are provided with the various parts are welded together. By doing so, the contact portion 52*c* of the electrode plate (first electroconductive portion contact) mounted to the developer chamber 11 and the folded back portion 42*a* of the first contacting electrode 42 mounted to the developer accommodating container 12 are contacted to each other so that an electric connection is established between the first electroconductive portion 50 and a first contacting electrode 54.

When the developer chamber (first frame) 11 and the developer accommodating container (second frame) 12 are fastened, a projection (unshown) provided in the developer accommodating container 12 is abutted to the developer chamber 11. By doing so, a predetermined gap is maintained between the first frame 11 and the second frame 12.

Figure 18:
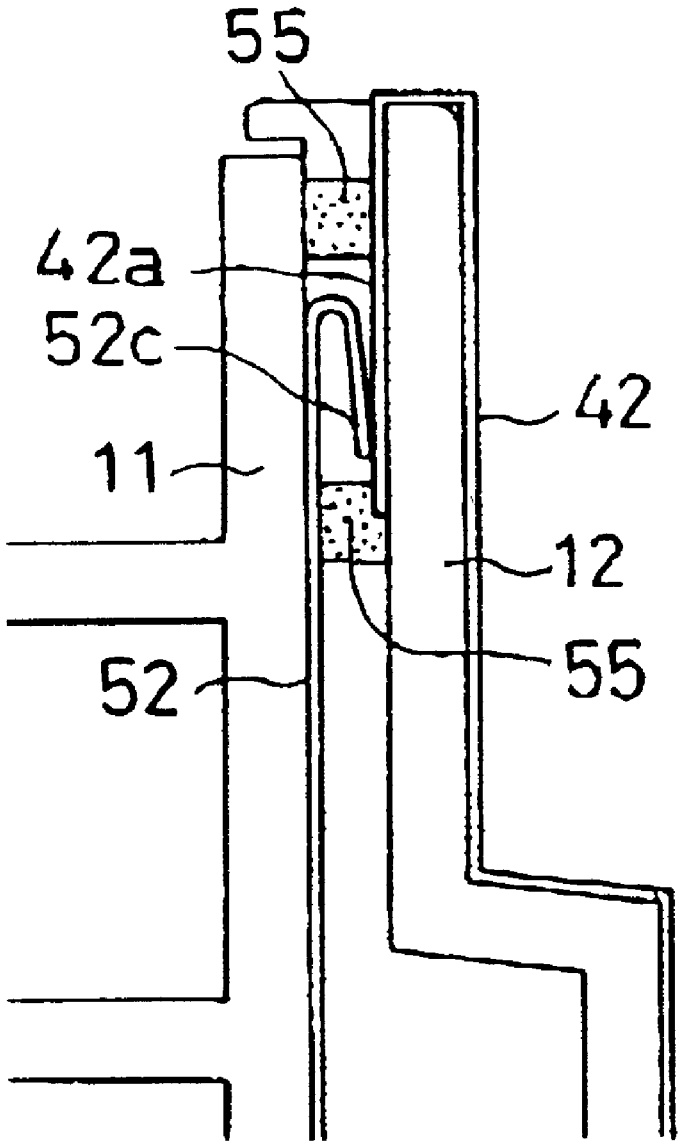
FIG. 18 is an enlarged longitudinal sectional view of a connecting portion between the developer chamber and the developer accommodating portion according to a further embodiment of the present intention.

FIG. 18 shows a section of a contact portion between the electrode plate 52 and the contact portion (folded back portion) 42*a* of the first contacting electrode 42. The contact portion 52*c* of the electrode plate 52 and the folded back portion 42*a* of the first contacting electrode 42 are sandwiched between the developer chamber 11 and the developer accommodating container 12 when the developer chamber 11 and the developer accommodating container 12 are welded to each other. By doing so, the contact portion 52*c* and the folded back portion 42*a* are press-contacted to each other with certainty.

In this manner, according to this embodiment, the first contacting electrode 42 and the electrode 52 connected to the first electroconductive portion 50 are sandwiched and contacted to each other between the developer accommodating container 12 and the developer chamber 11 at the space or cutaway portions 11*f* of the continuous welded portions 11*g,* 11*h.* By doing so, they are surely contacted between the developer chamber 11 and the developer accommodating container 12 so as to avoid improper contact or the like.

The structure of the first cartridge contact (input contact) 42*b* provided integrally and the other end of the first contacting electrode 42 and the structure of connecting the first cartridge contact 42*b* to the main assembly output contact (first main assembly cartridge contact) 30*a,* are similar to those of Embodiment 2.

The structure of the wiring from the second electroconductive portion 40 to the second contacting electrode (output contact electrode) is the same as with Embodiment 2. The structure of the second cartridge contact (output contact) 43*b* provided in the end cover 41 and the structure of connecting the second cartridge contact 43*b* to the main assembly output contact (second main assembly cartridge contact) 30*b,* are similar to those of Embodiment 2.

According to this embodiment, the electrical connection in the process cartridge is assured, too. Therefore, the voltage receivable by a process cartridge from the main assembly of the apparatus can be assuredly supplied to the predetermined member. By doing so, the electrical connection across the frames is assured.

In each of the embodiments, the connection between the first frame 11 and the second frame 12 are not limited to that using ultrasonic welding, but another welding, bonding material, snap fit and the like are usable.

In this invention, the frame is a frame to which the process means, such as a developing roller, is mounted, a developer accommodating container for accommodating the developer, or the like. The electrode (developer amount detection electrode, connection electrode) may be in the form of a leaf spring, a coil spring, a printed electroconductive material, as well as a metal plate or a metal rod. The electrical connection may be established by contact of electroconductive members by an integral electroconductive member.

As described in the foregoing, according to the present intention. the electrical connection in the process cartridge is assured.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an electrophotographic image forming apparatus, said process cartridge comprising:

an electrophotographic photosensitive member;

a developing member for developing an electrostatic latent image formed on said electrophotographic photosensitive member;

a developing device frame including a first frame portion supporting said developing member and a second frame portion having a developer accommodating portion for accommodating a developer to be used for developing the electrostatic latent image by said developing member;

first and second electroconductive portions disposed to be spaced from each other to detect, by the main assembly of the apparatus, a remaining amount of the developer in said process cartridge;

a cartridge contact electrically connectable with the main assembly of the apparatus when said process cartridge is mounted to the main assembly of the apparatus, said cartridge contact being disposed in said second frame portion;

a contacting electrode electrically connected with said cartridge contact, said contacting electrode being disposed in said second frame portion;

a first electroconductive portion contact electrically connected with said first electroconductive portion, said first electroconductive portion contact being disposed in said first frame portion; and a first connecting portion and a second connecting portion, provided in each of said first frame portion and said second frame portion, wherein said first connecting portion and said second connecting portion on each of said first frame portion and said second frame portion are disposed to be spaced from each other with respect to a longitudinal direction of said first frame portion and said second frame portion, and wherein said first electroconductive portion contact and said contacting electrode contact each other between said first connecting portions and said second connecting portions.

2. A process cartridge according to claim 1, wherein said first frame portion and said second frame portion are connected with each other by ultrasonic welding along a longitudinal direction at an ultrasonic weld portion therebetween, and wherein the ultrasonic weld portion therebetween includes a first welded portion and a second welded portion which are juxtaposed with a gap therebetween, and wherein said first electroconductive contact and said contacting electrode are disposed in the gap.

3. A process cartridge according to claim 1 or 2, wherein said cartridge contact is an input contact for receiving from the main assembly of the apparatus a bias voltage to be applied to said first electroconductive portion when said process cartridge is mounted to the main assembly of the apparatus, said process cartridge further comprising an output contact for transmitting through the main assembly of the apparatus an electrical signal corresponding to an electrostatic capacity between said first electroconductive portion and said second electroconductive portion.

4. A process cartridge according to claim 3, wherein said input contact and said output contact are provided at one longitudinal end surface of said process cartridge.

5. A process cartridge according to claim 3, wherein said input contact is provided at one longitudinal end surface of said developer accommodating portion, and said output contact is exposed to the outside from an end cover mounted to one longitudinal end of said first frame portion.

6. A process cartridge according to claim 1, wherein said first electroconductive portion contact is a separate member from said first electroconductive portion, and said first electroconductive portion contact is fastened together with said first electroconductive portion to said first frame by a screw.

7. A process cartridge according to claim 6, wherein said first electroconductive portion contact is provided with a bifurcated end portion which is folded back, and an end of the folded back bifuracted end portion is provided with a projection which contacts said contacting electrode by which said first electroconductive portion contact and said contacting electrode are electrically connected to each other.

8. A process cartridge according to claim 1, wherein said first electroconductive portion and said second electroconductive portion are mounted to said first frame.

9. A process cartridge according to claim 6, 7 or 8, wherein said first electroconductive portion and said second electroconductive portion are made of stainless steel, and said first electroconductive portion contact is made of phosphor bronze.

10. A process cartridge according to claim 1, wherein said contacting electrode and said cartridge contact are provided at one and the other ends of an integral metal member.

11. A process cartridge according to claim 2, 6, 7, 8 or 10, wherein said first electroconductive portion contact is enclosed with a seal member which is sandwiched and compressed between said first frame portion and said second frame portion.

12. A process cartridge detachably mountable to a main assembly of an electrophotographic image forming apparatus, said process cartridge comprising:

an electrophotographic photosensitive drum;

a developing roller for developing an electrostatic latent image formed on said electrophotographic photosensitive member with a developer;

a first frame portion supporting said developing roller and a second frame portion having a developer accommodating portion for accommodating a developer to be used for developing the electrostatic latent image;

first and second electroconductive portions in the form of plates disposed to be spaced from each other to detect, by the main assembly of the apparatus, a remaining amount of the developer in said process cartridge, wherein said first electroconductivc portion and said second electroconductive portion are mounted to said first frame portion;

an input contact for receiving from the main assembly of the apparatus a bias voltage to be applied to said first electroconductive portion when said process cartridge is mounted to the main assembly of the apparatus;

an output contact for transmitting to the main assembly of the apparatus an electrical signal corresponding to an electrostatic capacity between said first electroconductive portion and said second electroconductive portion, wherein the electrostatic capacity is provided when the bias voltage is applied to said first electroconductive portion from said input contact, wherein said input contact and said output contact are provided at one longitudinal end of said process cartridge;

a contacting electrode electrically connected with said cartridge contact, said contacting electrode being disposed in said second frame portion; and a first electroconductive portion contact electrically connected with said first electroconductive portion and disposed in said first frame portion, said first electroconductive portion contact being enclosed with an elastic seal member, wherein said elastic seal member is sandwiched and compressed between said first frame portion and said second frame portion, and said first frame portion and said second frame portion are connected to each other at an ultrasonic weld portion by ultrasonic welding along a longitudinal direction, and the ultrasonic weld portion includes a first welded portion and a second welded portion which extend with a gap therebetween with respect to the longitudinal direction, and wherein said first electroconductive portion contact and said contacting electrode are disposed in the gap and contact each other in the gap.

13. A process cartridge according to claim 12, wherein said input contact is provided at one longitudinal end surface of said developer accommodating portion, and said output contact is exposed to the outside from an end cover mounted to one longitudinal end of said first frame portion.

14. A process cartridge according to claim 12, wherein said first electroconductive portion contact is a separate member from said first electroconductive portion, and said first electroconductive portion contact is fastened together with said first electroconductive portion to said first frame by a screw.

15. A process cartridge according to claim 14, wherein said first electroconductive portion contact is provided with a bifurcated end portion which is folded back, and an end of the folded back bifurcated end portion is provided with a projection which contacts said contacting electrode by which said first electroconductive portion contact and said contacting electrode are electrically connected to each other.

16. A process cartridge according to claim 12, 13, 14 or 15, wherein said first electroconductive portion and said second electroconductive portion are made of stainless steel, and said first electroconductive portion contact is made of phosphor bronze.

17. A process cartridge according to claim 12, wherein said contacting electrode and said cartridge contact are provided at one and the other ends of an integral metal member.

18. An electrophotographic image forming apparatus for forming an image on the recording material, to which a process cartridge is detachably mountable, said apparatus comprising:

(a) a main assembly cartridge contact; and (b) mounting means for detachably mounting the process cartridge, the process cartridge including:

an electrophotographic photosensitive member;

a developing member for developing an electrostatic latent image formed on the electrophotographic photosensitive member;

a developing device frame including a first frame portion supporting the developing member and a second frame portion having a developer accommodating portion for accommodating a developer to be used for developing the electrostatic latent image by the developing member;

first and second electroconductive portions disposed to be spaced from each other to detect, by the main assembly of said apparatus, a remaining amount of the developer in the process cartridge;

a cartridge contact electrically connectable with said main assembly cartridge contact when the process cartridge is mounted to the main assembly of said apparatus, the cartridge contact being disposed in the second frame portion;

a contacting electrode electrically connected with the cartridge contact, the contacting electrode being disposed in the second frame portion;

a first electroconductive portion contact electrically connected with the first electroconductive portion, the first electroconductive portion contact being disposed in the first frame portion; and a first connecting portion and a second connecting portion, provided in each of the first frame portion and the second frame portion, wherein the first connecting portion and the second connecting portion on each of the first frame portion and the second frame portion are disposed to be spaced from each other with respect to a longitudinal direction of the first frame portion and the second frame portion, and the first electroconductive portion contact and the contacting electrode contact each other at a connecting portion between the first connecting portions and the second connecting portions.

19. An electrophotographic image forming apparatus for forming an image on the recording material, to which a process cartridge is detachably mountable, said apparatus comprising:

(a) a main assembly input contact;

(b) a main assembly output contact; and (c) mounting means for detachably mounting a process cartridge, the process cartridge including;

an electrophotographic photosensitive member;

a developing roller for developing an electrostatic latent image formed on the electrophotographic photosensitive member with a developer;

a first frame portion supporting the developing roller and a second frame portion having a developer accommodating portion for accommodating a developer to be used for developing the electrostatic latent image;

first and second electroconductive portions in the form of plates disposed to be spaced from each other to detect, by the main assembly of said apparatus, a remaining amount of the developer in the process cartridge, wherein the first electroconductive portion and the second electroconductive portion are mounted to the first frame portion;

an input contact for receiving from said main assembly input contact a bias voltage to be applied to the first electroconductive portion when the process cartridge is mounted to the main assembly of said apparatus;

an output contact for transmitting to said main assembly output contact an electrical signal corresponding to an electrostatic capacity between the first electroconductive portion and the second electroconductive portion, wherein the electrostatic capacity is provided when the bias voltage is applied to the first electroconductive portion from the input contact, wherein the input contact and the output contact are provided at one longitudinal end of the process cartridge;

a contacting electrode electrically connected with the cartridge contact, the contacting electrode being disposed in the second frame portion; and first electroconductive portion contact electrically connected with the first electroconductive portion and disposed in the first frame portion, the first electroconductive portion contact being enclosed with an elastic seal member, wherein the elastic seal member is sandwiched and compressed between the first frame portion and the second frame portion, and wherein said first frame portion and the second frame portion are connected to each other at an ultrasonic weld portion by ultrasonic welding along a longitudinal direction, and the ultrasonic weld portion includes a first welded portion and a second welded portion which extend with a gap therebetween with respect to the longitudinal direction, and wherein the first electroconductive portion contact and the contacting electrode are disposed in the gap and contact each other in the gap.

* * * * *

UNITED STATES PATENT AND TRADEMARK OFFICE

CERTIFICATE OF CORRECTION

PATENT NO. : 6,571,070 B2
DATED : May 27, 2003
INVENTOR(S) : Toru Oguma et al.

It is certified that error appears in the above-identified patent and that said Letters Patent is hereby corrected as shown below:

Title page
Item [57], ABSTRACT,
Line 27, "between" should be deleted.
Line 28, should be deleted.
Line 29, before "between" insert -- at a connection portion --.

Column 1,
Line 5, "AT" should read -- ART --.
Line 20, "make" should read -- may --.

Column 3,
Line 54, "presentation" should read -- present invention --.
Line 66, "presenta-" should read -- present --.
Line 67, "tion." should read -- invention. --.

Column 5,
Line 31, "process" should read -- process. --.

Column 6,
Line 53, "18" should read -- 18. --.
Line 61, "riot" should read -- not --.

Column 11,
Line 18, "apparatus" should read -- the apparatus --.
Line 27, "apparatus" should read -- the apparatus. --.
Line 35, "bent" should read -- bent. --.

Column 14,
Line 53, "intention." should read -- intention, --.

UNITED STATES PATENT AND TRADEMARK OFFICE

CERTIFICATE OF CORRECTION

PATENT NO. : 6,571,070 B2
DATED : May 27, 2003
INVENTOR(S) : Toru Oguma et al.

It is certified that error appears in the above-identified patent and that said Letters Patent is hereby corrected as shown below:

Column 18,
Line 15, "including;" should read -- including: --.

Signed and Sealed this

Third Day of February, 2004

JON W. DUDAS
*Acting Director of the United States Patent and Trademark Office*